US006655304B1

(12) United States Patent
Barlow

(10) Patent No.: US 6,655,304 B1
(45) Date of Patent: Dec. 2, 2003

(54) MASS FUEL COMBUSTION SYSTEM

(75) Inventor: James L. Barlow, Fort Collins, CO (US)

(73) Assignee: Barlow Projects, Inc., Fort Collins, CO (US)

( * ) Notice: Subject to any disclaimer, the term of this patent is extended or adjusted under 35 U.S.C. 154(b) by 0 days.

(21) Appl. No.: 09/979,694

(22) PCT Filed: May 20, 2000

(86) PCT No.: PCT/US00/13791

§ 371 (c)(1),
(2), (4) Date: Nov. 21, 2001

(87) PCT Pub. No.: WO00/71937

PCT Pub. Date: Nov. 30, 2000

Related U.S. Application Data

(60) Provisional application No. 60/135,527, filed on May 21, 1999.

(51) Int. Cl.[7] ..... F23K 3/08; F23H 17/00; F23J 1/00

(52) U.S. Cl. ..... 110/347; 110/204; 110/205; 110/268; 110/328; 110/165 R

(58) Field of Search ..... 110/190, 205, 110/235, 258, 268, 328, 346, 101 CD, 165 R, 165 A, 347, 204, 242, 108, 101 R; 126/170, 155

(56) References Cited

U.S. PATENT DOCUMENTS

| | | | | |
|---|---|---|---|---|
| 654,774 | A | 7/1900 | Wood | |
| 1,664,082 | A | 3/1928 | Mildon | |
| 2,072,450 | A | 3/1937 | Hobson, Jr. | 110/28 |
| 3,334,599 | A | 8/1967 | Tanner | 110/8 |
| 3,552,333 | A | 1/1971 | Salamon | 110/8 |
| 3,556,025 | A | 1/1971 | Holley | 110/8 |
| 3,557,723 | A | 1/1971 | Miller | 110/6 |
| 3,559,597 | A | 2/1971 | Heiny | 110/10 |
| 3,559,598 | A | 2/1971 | McClare | 110/18 |
| 3,566,810 | A | 3/1971 | Sprague | 110/39 |
| 3,577,938 | A | 5/1971 | Muirhead | 110/8 |
| 3,645,217 | A | 2/1972 | Akroyd | 110/8 |
| 3,651,770 | A | 3/1972 | Hotti | 110/8 R |
| 3,669,039 | A | 6/1972 | Leman | 110/7 A |
| 3,745,941 | A | 7/1973 | Reilly | 110/8 R |
| 3,771,470 | A | 11/1973 | Hampton | 110/8 R |
| 3,797,415 | A | 3/1974 | Young, Jr. et al. | 110/8 |

(List continued on next page.)

FOREIGN PATENT DOCUMENTS

| | | | |
|---|---|---|---|
| DE | 0611919 B1 * | 6/2003 | F23N/1/02 |
| RU | 2099638 C1 | 12/1997 | |
| SU | IC 237317 | 11/1969 | |
| WO | WO 00/71937 A1 | 11/2000 | |

OTHER PUBLICATIONS

US. Provisional Patent Application No. 60/135,527, entitled "Improved Combustion Process", filed May 21, 1999.

PCT International Patent Application No. PCT/US00/13791, filed May 20, 2000, entitled "Improved Mass Fuel Combustion System".

*Primary Examiner*—Ira S. Lazarus
*Assistant Examiner*—K. B. Rinehart
(74) *Attorney, Agent, or Firm*—Santangelo Law Offices, P.C.

(57) ABSTRACT

An improved mass fuel combustion system can be designed in a variety of embodiments and alternatives, including designs which include independent gas feeds, independent gas pulsing, independently controllable vibration systems and an overall control system which can coordinate a host of parameters for optimal combustion. One design includes overlapping grate elements (50) through which combustion gas is introduced and may include apertures to introduce a pulsed mix gas as well as a separate temperature control gas. Efficient poppet designs (44) can be used to provide an economical and efficient combustion system.

164 Claims, 13 Drawing Sheets

U.S. PATENT DOCUMENTS 3,812,794 A 5/1974 Taylor ..... 110/8 R
3,823,677 A 7/1974 Polsak ..... 110/8 C
3,863,578 A 2/1975 Kato et al. ..... 110/8 R
3,870,652 A 3/1975 Whitten et al. ..... 252/421
3,924,548 A 12/1975 Du Chambon ..... 110/8 C
3,926,130 A 12/1975 Stloukal et al. ..... 110/10
3,937,155 A 2/1976 Kunstler ..... 110/18 R
3,951,081 A 4/1976 Martin et al. ..... 110/8 P
3,955,512 A 5/1976 Martin et al. ..... 110/8 R
3,995,568 A 12/1976 Dvirka et al. ..... 110/8 R
4,027,603 A 6/1977 Lohner ..... 110/18 R
4,038,930 A 8/1977 Barkhuus ..... 110/8 A
4,060,041 A 11/1977 Sowards ..... 110/8 F
4,080,910 A * 3/1978 Jaccoud ..... 110/210
4,103,627 A 8/1978 Mainka ..... 110/281
4,193,354 A 3/1980 Woods ..... 110/212
D254,749 S 4/1980 Johansson ..... D23/125
4,200,047 A 4/1980 Knorr ..... 110/281
4,210,087 A 7/1980 Melan et al. ..... 110/346
D256,723 S 9/1980 Wills ..... D23/85
4,250,818 A 2/1981 Sigg ..... 110/278
4,335,660 A 6/1982 Maloney et al. ..... 110/206
4,366,759 A 1/1983 Foresto ..... 110/225
4,385,567 A * 5/1983 Voss ..... 110/186
4,389,978 A * 6/1983 Northcote ..... 122/4 D
4,389,979 A 6/1983 Saxlund ..... 122/15
4,429,664 A 2/1984 Feldhoff et al. ..... 122/376
4,430,948 A 2/1984 Schafer et al. ..... 110/101 R
4,432,287 A 2/1984 Brillantes ..... 110/212
4,434,725 A 3/1984 Foresto ..... 110/346
4,438,705 A 3/1984 Basic, Sr. ..... 110/235
4,454,860 A 6/1984 Schafer et al. ..... 126/110 R
4,463,688 A 8/1984 Andreoli ..... 110/298
4,475,468 A 10/1984 Ishikawa et al. ..... 110/257
4,475,469 A 10/1984 Basic, Sr. ..... 110/281
4,491,077 A 1/1985 Petty et al. ..... 110/278
4,494,469 A 1/1985 da Silva Pinto ..... 110/281
4,495,872 A * 1/1985 Shigaki ..... 110/190
4,510,873 A 4/1985 Shigaki ..... 110/289
4,512,266 A 4/1985 Shigaki ..... 110/204
4,516,511 A 5/1985 Kuo ..... 110/346
4,528,917 A 7/1985 Jacobs ..... 110/300
4,563,959 A 1/1986 Fujiwara ..... 110/281
4,576,101 A 3/1986 Reschly ..... 110/182.5
4,610,208 A * 9/1986 Lersten et al. ..... 110/246
4,676,176 A 6/1987 Bonomelli ..... 110/281
4,694,757 A 9/1987 Hawkins et al. ..... 110/271
4,709,662 A 12/1987 Rawdon ..... 122/4 D
4,719,900 A 1/1988 Martin ..... 126/163
4,724,779 A 2/1988 White et al. ..... 110/281
4,732,561 A 3/1988 Eiring et al. ..... 432/78
4,745,884 A 5/1988 Coulthard ..... 122/4 D
4,753,180 A 6/1988 Narisoko et al. ..... 110/346
4,762,489 A 8/1988 Schmits et al. ..... 432/77
4,771,709 A 9/1988 Applegate ..... 110/235
4,838,183 A 6/1989 Tsaveras et al. ..... 110/190
4,895,084 A 1/1990 Kroon et al. ..... 110/255
4,936,231 A 6/1990 Johnson ..... 110/235
4,949,653 A 8/1990 Rast ..... 110/235
4,954,034 A 9/1990 Nelson et al. ..... 414/156
4,955,296 A * 9/1990 Barlow ..... 110/300
4,975,045 A 12/1990 Green et al. ..... 431/183
4,992,043 A * 2/1991 Lockwood ..... 432/58
5,010,830 A 4/1991 Asuka et al. ..... 110/347
5,044,288 A 9/1991 Barlow ..... 110/346
5,081,940 A 1/1992 Montomura et al. ..... 110/346
5,086,714 A 2/1992 Hladun ..... 110/281
5,087,269 A 2/1992 Cha et al. ..... 44/626
5,138,958 A 8/1992 Sinquin ..... 110/346
5,230,293 A 7/1993 Schirmer ..... 110/346
5,241,916 A * 9/1993 Martin ..... 110/348
5,245,936 A 9/1993 Nakata ..... 110/251
5,271,339 A 12/1993 Yamagishi et al. ..... 110/281
5,279,234 A * 1/1994 Bender et al. ..... 110/210
5,291,840 A 3/1994 Nakao ..... 110/235
5,302,115 A 4/1994 Hagar et al. ..... 431/183
5,307,746 A * 5/1994 Khinki et al. ..... 110/245
5,309,850 A * 5/1994 Downs et al. ..... 110/235
5,311,828 A 5/1994 Wu et al. ..... 110/248
5,495,948 A 3/1996 Ishida et al. ..... 209/11
5,538,128 A 7/1996 Stierll et al. ..... 198/773
5,553,554 A * 9/1996 Urich ..... 110/211
5,606,924 A * 3/1997 Martin et al. ..... 110/341
5,626,089 A 5/1997 Schneider et al. ..... 110/281
5,671,687 A 9/1997 Chen ..... 110/212
5,722,333 A 3/1998 Hyun ..... 110/247
5,906,806 A * 5/1999 Clark ..... 423/437.1

* cited by examiner

MASS FUEL COMBUSTION SYSTEM

TECHNICAL FIELD

This invention is primarily directed to an improved stationary combustion apparatus designed to utilize solid fuel such as household and industrial waste, it will be understood that any of various types of combustible, particulate materials may serve as the supply fuel feed for the instant apparatus. The term "mass fuel" referred to herein, is intended to mean any matter being combusted while resting on a surface or traveling on or along a surface. This might be distinguished from methods in which the matter is purposefully suspended in air a substantial distance above a surface. It might also be distinguished from methods, which require the matter to be fragmented before combustion. Mass fuel applications which this invention may be utilized include, but are not limited to elastomeric products, coal, waste coal, sewage sludge, biomass products, municipal solid waste, industrial waste, infectious waste, and manure. Generally, this invention relates to combustion systems which may be utilized as an apparatus and method for the combustion of mass fuel. Specifically, the invention is intended to provide an improved technique for efficiently combusting a mass fuel, possibly having widely varying combustion characteristics, upon a grate assembly in an incinerator or furnace. The combustion system is designed specifically to be an improvement over current incinerator or combustion grate assemblies and current methods of combusting a mass fuel.

BACKGROUND

The difficulty of burning certain mass fuels such as refuse is well known. Refuse often includes a high percentage of slow-burning or wet materials, which can impede combustion and exhibit an erratic burn rate. Furthermore, such compositions can vary continuously with the weather, season, area where collected, conditions under which stored and other uncontrollable and unpredictable variables.

One known method of burning or combusting refuse incorporates the use of a combustion grate for supporting the fuel during combustion. The method can be directed at dividing the combustion grate into two or three separate treatment zones and, through plenum or supply chambers, may provide combustion air under differing parameters to each one, varying the characteristics of the air to suit the combustion needs. Thus, the air in the first zone containing fresh, un-burned refuse may be heated to dry out the trapped moisture, with combustion possibly not commencing until the refuse has entered the next zone, which may be supplied with a different air mix. The control of combustion in various zones has sometimes been thought to be limited to varying the characteristics of the air flowing to each zone. However, as the thickness of the refuse layer and its combustion characteristics may not be uniform across any one zone, burning time may be longer, possibly dictated by the slowest burning area on the grate.

It can, therefore, be desirable to divide the grate surface into additional zones and to provide independent control of the combustion in each zone to maximize combustion efficiency. Furthermore, the control could optimally be as automatic as possible, so that each zone can be monitored and adjusted continuously, in an effort to maximize the efficiency of the burning to obtain the greatest throughput of fuel. In regard to combustion efficiency, the throughput of fuel may include the disposal through combustion of an input feed material, and or in the alternative, the production of a source of energy, such as heated air, water or steam from the burning operation.

Optimal burn or combustion efficiency may be achieved by simultaneously mixing or agitating the mass fuels and burning or combustion. Although the simultaneous steps of agitating and combusting of mass fuels may have been previously performed in prior combustion techniques, the overall objective of agitating and combusting may be performed in a variety of systems to further optimize combustion efficiency. In particular, it can be desirable to provide a means for mixing or agitating the fuel in specific ways during the combustion process. The result can be such that the overall combustion efficiency is improved.

One system often available for performing mass fuel agitation prior to the present invention appears to provide a stepped combustion grate, whereby a part or all of the steps move in a fashion which apparently aids in the overall mixing and travel of the fuel in a predominant direction. However, it may be desirable to provide a combustion system that incorporates less mechanical complexity than a moving grate system to possibly enhance the economics of the system as well as the throughput or combustion efficiency.

A system to accomplish the mixing or agitation of mass fuel may provide combustion air being fed through the grate assembly as the source of agitation. However, the use of combustion air for the dual purpose of combustion and agitation presents additional problems of system optimization. The use of one controlled air source for combustion as well as fuel agitation may not allow for the optimization of either the combustion or the agitation. In particular, the system may maintain the required combustion air flow to support the overall combustion process. However, the specific requirements needed for the agitation may be neglected. Similarly, the system may maintain the requirements needed to perform the agitation of the fuel. However, the necessary requirements for the proper oxygen-to-fuel ratio for combustion may be neglected either with too much or too little air. Combined with the possible need to adjust to varying fuel combustion characteristics in many instances, the ability to efficiently perform both the task of combustion air supply and fuel agitation with one air source is hampered. Therefore, it is desirable to accomplish both efficient combustion air supply and fuel agitation in a mass fuel combustion system to provide improvement in the overall system efficiency.

One system in particular, previously developed and patented as U.S. Pat. Nos. 4,955,296 and 5,044,288 by the inventor of the present invention, and hereby incorporated by reference, discloses an apparatus and method for the combustion of mass fuel incorporating a stationary grate plate assembly in the combustion system. The system may include an inclined assembly with perforated support tubes for the introduction of agitation air at particular locations along the stepped grate assembly. Combustion and agitation may occur at separate treatment zones along the grate surface in a controlled manner. Although excellent in its addressing of the problems intended, even the above referenced designs can be improved upon. They may not have provided as efficient an introduction source for combustion air and agitation air to the grate assembly as is now possible. System throughput or efficiency may be further enhanced in a system for introducing the combustion air and agitation air by optimized introduction defined by the particular grate plates.

Furthermore, the above referenced patents may also not have optimally provided for the efficient control of combustion parameters apart from combustion air and mix air control. Other system parameters may be monitored and controlled to further enhance the combustion efficiency. It would be desirable, then, to monitor and control the combustion system based upon system parameters, such as, by way of example and not of limitation, combustion chamber temperature, oxygen content of chamber air, carbon monoxide content of chamber air, and mass fuel feed rate, among others. Furthermore, the use of combusted air from the process may be used to further enhance system parameters such as, again by way of example and not of limitation, recycled air for combustion chamber temperature control. System parameters may further be optimized by a particular coordination of air introduction within the combustion system. It is desirable, therefore, to provide a combustion system that can monitor and control combustion parameters of the system and can optimize the parameters through the efficient use and introduction of multiple air sources.

Additionally, agglomerated combustion by-product or perhaps even slag may form within combustion systems resulting from the spent or combusted mass fuel accumulating within the system. A need, therefore, may exist to efficiently remove agglomerated combustion by-product within the system to optimize the throughput of as yet uncombusted fuel or otherwise.

DISCLOSURE OF THE INVENTION

The present invention provides a combustion system that addresses the inadequacies that may have existed with prior incineration or combustion systems. Accordingly, the present invention provides a mass fuel combustion furnace and methods for combusting a mass fuel.

It is an object, therefore, of the present invention to provide an improved combustion system for combusting a mass fuel. In particular, it is an object of the present invention to provide a combustion system for combusting a mass fuel that improves the speed of response and flexibility in the control of combustion of mass fuels. A goal of the present invention therefore can be to provide a combustion system that injects a secondary agitation gas into the fuel mass which can lift, agitate, dry and control the migration of the fuel during the combustion process.

It may be a further an object of the present invention to provide a combustion system for combusting a mass fuel without the need for or degree of mechanical movement typically associated with the grate assembly. A goal of the present invention therefore is to provide a combustion system that allows the grate to be "stationary" to a large degree.

It can be a further object of the present invention to provide a combustion system for combusting a mass fuel without adversely affecting the combustion process. A goal of the present invention therefore is to provide a combustion system that limits the addition of significant excess oxygen, such as atmospheric air in the fuel introduction system.

Yet another object of the present invention may be to provide a combustion system for combusting a mass fuel that provides for agitation gas injection with a plurality of injection points and to independently control the rate of delivery of the gas flow at each point. A goal of the present invention therefore is to provide a combustion system with control of the velocity or flow of the mix gas at each point where it is released into the fuel and to provide a force available for performing the tasks of mixing, drying and controlling the migration rate of the material.

In particular, it may be an object of the present invention to provide a combustion system for combusting a mass fuel that enhances throughput and combustion efficiency in a system for introducing the combustion gas and agitation gas. A goal of the present invention therefore is to provide a combustion system that optimizes agitation gas introduction defined by the particular grate plates.

Still another object of the present invention is to provide a combustion system that minimizes variations in heat release rates during the combustion process. A goal of the present invention therefore is to provide a combustion system that controls the fuel feed rate to the combustion process.

It is further an object of the present invention to provide a combustion system for combusting a mass fuel that minimizes the effects of agglomerated combustion by-product during the combustion process that may discharge through the combustion grate. A goal of the present invention therefore is to provide a combustion system that efficiently provides for the removal of ash and agglomerated combustion by-product.

In particular, it is an object of one embodiment of the present invention to provide a combustion system for combusting a mass fuel that efficiently controls the overall combustion process using multiple parameters. A goal of the present invention therefore is to provide a combustion system that monitors and optimizes parameters within the system.

In particular, it may be an object of the present invention to provide a combustion system for combusting a mass fuel that provides a plurality of treatment zones for efficient combustion control and subsequent agglomerated combustion by-product removal. A goal of the present invention therefore is to provide a combustion system with multiple treatment zones, each zone having a separate introduction of combustion and agitation gases, independent rate control of delivery of combustion and agitation gas and separate agglomerated combustion by-product reduction method.

Another object of the present invention is to provide a combustion system for combusting a mass fuel that provides control of the temperatures on the combustion grate surface and throughout the combustion process. A goal of the present invention therefore is to provide a combustion system using exhaust gas, agitation gas and other types of control.

Other objects of the invention are disclosed throughout other areas of the specification and claims. In addition, the goals and objectives may apply either in dependent or independent fashion to a variety of other goals and objectives in a variety of embodiments.

MODE(S) FOR CARRYING OUT THE INVENTION

As can be easily understood, the basic concepts of the present invention may be embodied in a variety of ways. It involves both methods and devices to accomplish the appropriate method. In this disclosure, the methods are disclosed as part of the results shown to be achieved by the various devices described and as steps that are inherent to utilization. They are simply the natural result of utilizing the devices as intended and described. In addition, while some devices are disclosed, it would be understood that these not only accomplish certain methods, but also can be varied in many ways. Importantly, as to the foregoing, all these facets should be understood to be encompassed by this disclosure.

Although this invention is primarily directed to an improved stationary combustion system designed to utilize "mass" or solid fuels such as household and industrial waste, it will be understood that any of various types of combustible, particulate materials may serve as the combusting fuel for the instant system. The term "mass fuel" or "solid fuel", referred to herein, is intended to mean any matter being combusted while resting on a surface or traveling on or along a surface. In one embodiment the system might also be distinguished from other systems in which the matter is purposefully suspended in air a substantial distance above a surface. It might also be distinguished from other systems which require the matter to be fragmented before combustion. Mass fuel applications in which this invention may be utilized may include, but are not limited to, elastomeric products, coal, waste coal, sewage sludge, biomass products, municipal solid waste, industrial waste, infectious waste, and manure.

Figure 1:
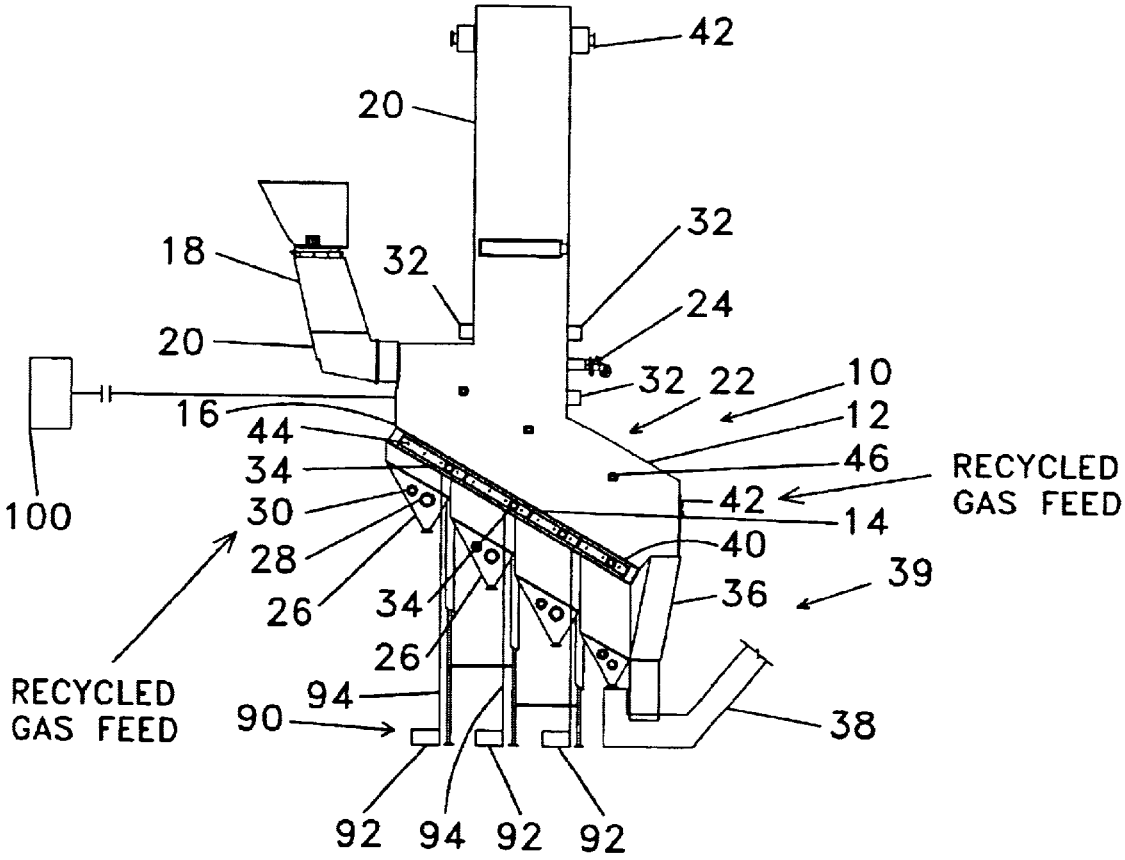
FIG. 1 is a partial cross-sectional and elevation view of one embodiment of the invention showing a combustion system.

As can be understood from the drawings, the basic concepts of the present invention may be embodied in different ways. FIG. 1 shows a partial cross-sectional and elevation view of one embodiment of a combustion system of the present invention. As shown, the combustion system of the present invention may relate to a furnace or incinerator, generally designated (10), which may be employed for the purpose of merely incinerating an input mass fuel for disposal or to generate a source of energy, such as hot air, heated water or steam. In this respect, peripheral housing or walls (12) of the furnace may be configured in any suitable well-known manner according to the intended use of the furnace.

Figure 2:
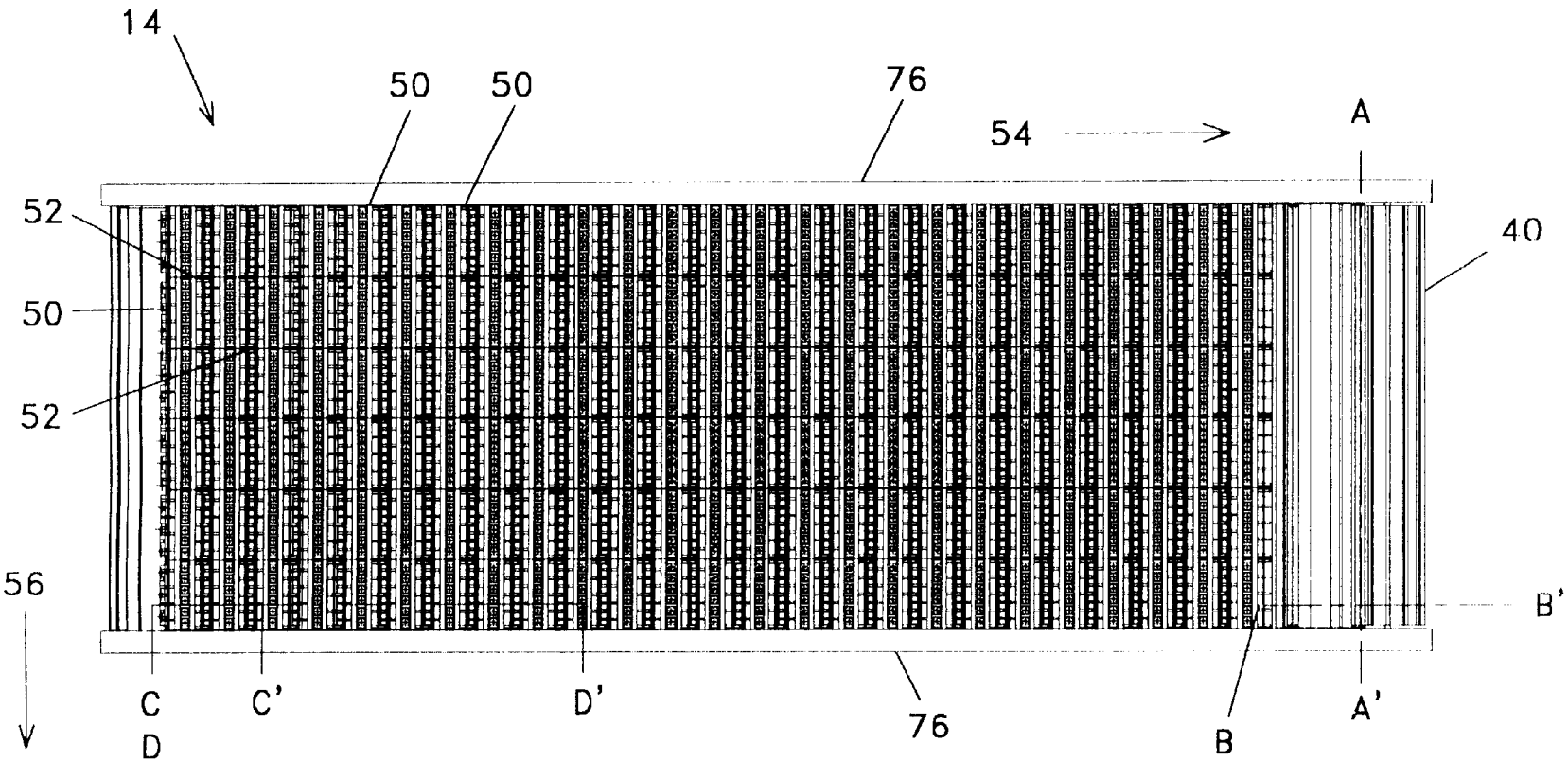
FIG. 2 is a plan view of one embodiment of a grate assembly.
Figure 4:
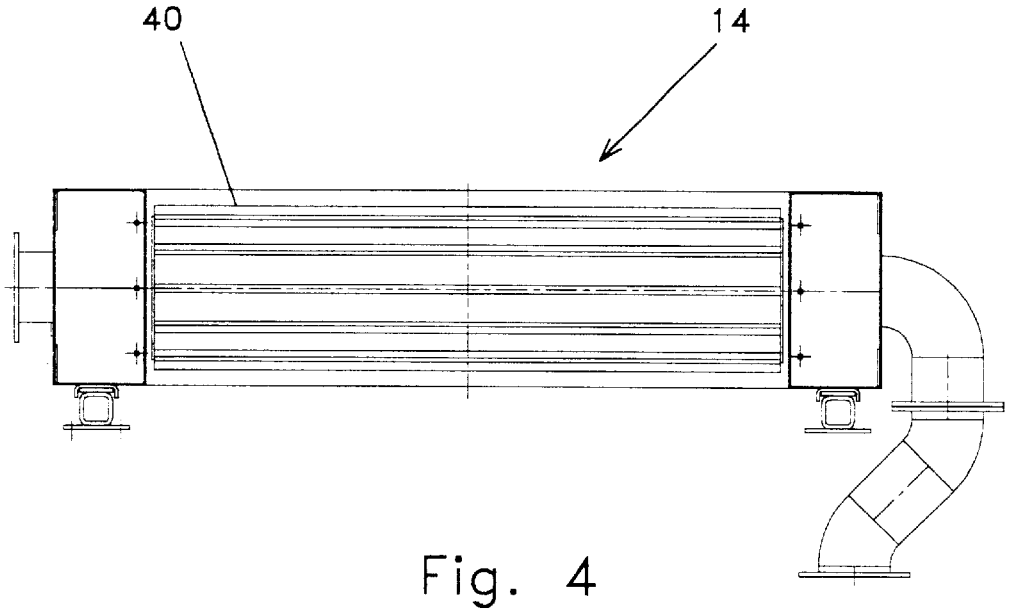
FIG. 4 is an end view, featuring one embodiment of the ash roller, of the grate assembly embodiment depicted in FIG. 2.
Figure 3:
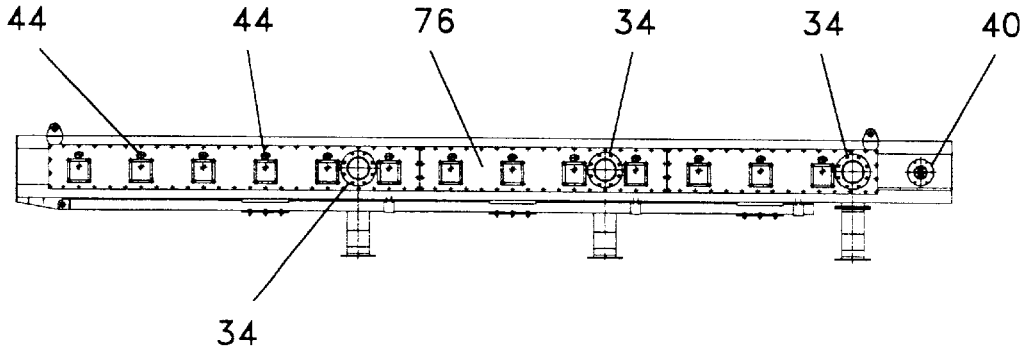
FIG. 3 is a side view of the grate assembly embodiment depicted in FIG. 2.

In particular, and with references to FIGS. 1 and 2, the present invention may be directed to the design and configuration of a grate system or assembly (14) serving, in one embodiment of the present invention, to receive and dispose of mass fuel or other material (16) during a combustion process. "Combustion process" or "combustion system" refers generally to a system, inherently including methods and associated devices, for receiving a fuel and combusting the fuel to produce an energy release and to result in substantially combusted material, typically in the form of ash. As is known, by-products of the combustion process may include, but are not limited to, un-combusted material and agglomerated combustion by-product, or even slag (whether used in its technical or vernacular sense) generated by the combustion of mass fuel. In a preferred embodiment, the combustion process takes place substantially on the surface of the grate assembly (14). Preferably, the suspension of un-combusted and combusting mass fuel is minimized in order to maintain complete and efficient combustion of all the supplied mass fuel from the mass fuel feed such as the vertical hopper assembly (18) and feed element or feed table (20).

The grate system or assembly (14) can provide numerous advantages in the disclosed plurality of embodiments. One important advantage is that numerous types of particulate, solid or semi-solid materials, i.e. mass fuels as described supra, exhibiting a wide range of parameters, particularly combustion characteristics, are readily accommodated by the grate assembly (14) given the attendant features of the disclosed combustion system described in various embodiments below. Therefore, an optimum amount of combustion of the mass fuel fed into the system can occur with minimum ash and agglomerated combustion by-product remaining for disposal after or during combustion.

The furnace (10) may further comprise generally, in a preferred embodiment, an upper combustion chamber (20) and a lower combustion chamber (22) where combustion of the mass fuels may preferably take place. An auxiliary burner (24) may also be provided to aid in the start-up and shut down of the combustion system. Combustion gas, and in a preferred embodiment combustion air, can be provided to at least one combustion gas feed or plenums (26) via combustion gas plenum inlets (28). In alternative embodiments, the combustion gas feeds (26) may alternatively or in combination serve as a siftings hopper for combusted mass fuel or ash and for agglomerated combustion by-product from the combusted mass fuel. Furthermore, the combustion gas feeds may alternatively or in combination serve to receive recycled exhaust or combusted gas via plenum inlets (30) to help control combustion parameters, such as temperature or oxygen content as more particularly described below. Recycled exhaust or combusted gas may additionally be introduced into the combustion system via inlets (42). In preferred embodiments, combustion gas may also be introduced through top or bottom combustion gas feeds. This is shown as the top feed embodiment through upper inlets (32).

According to a preferred embodiment, gas may be introduced via the various plenums (26) and inlets (28) (32) and

(42) to provide a post-combustion gas feed to the combustion chambers. The introduction of post-combustion gas may serve a variety of purposes, including, but not limited to, the temperature regulation of the combustion chamber and the reduction of ash and agglomerated combustion by-product from the grate assembly and combustion chambers. Post-combustion gas introduction may be performed via a recycled combusted gas system wherein the post-combustion gas introduced may preferably be combusted gas. Additionally, plenums (26) may serve to introduce gases other than combustion or recycled gases, depending on the particular demands of the combustion process, and may include introducing other gases, including, but not limited to, a second combustion gas, uncombustible gases, and grate-cooling gases, among others.

Secondary or even agitation gas feeds (34) may provide, in preferred embodiments, a secondary or agitation or mixing gas source such as for the agitation or mixing of mass fuel, as more fully described below. The secondary gas feeds may further provide, in preferred embodiments for the transportation of mass fuel from an inlet end of the grate assembly (14) near mass fuel feed elements (18) and (20) to an outlet end of the grate assembly near combusted mass fuel or discharge chute (36) and combusted mass fuel or ash conveyor (38). The secondary gas may serve to impart motion or lift to materials located on the grate assembly (14). Additionally, and in preferred embodiments, the secondary or agitation gas feeds may supply secondary gas to dry the materials located on the grate assembly. In this manner, a mass fuel located upon the grate assembly may be mixed or agitated, dried and migrated along the grate assembly. The introduction and control of a secondary or an agitation gas to the grate system may be provided by gas poppets (44), more fully described below.

Figure 8:
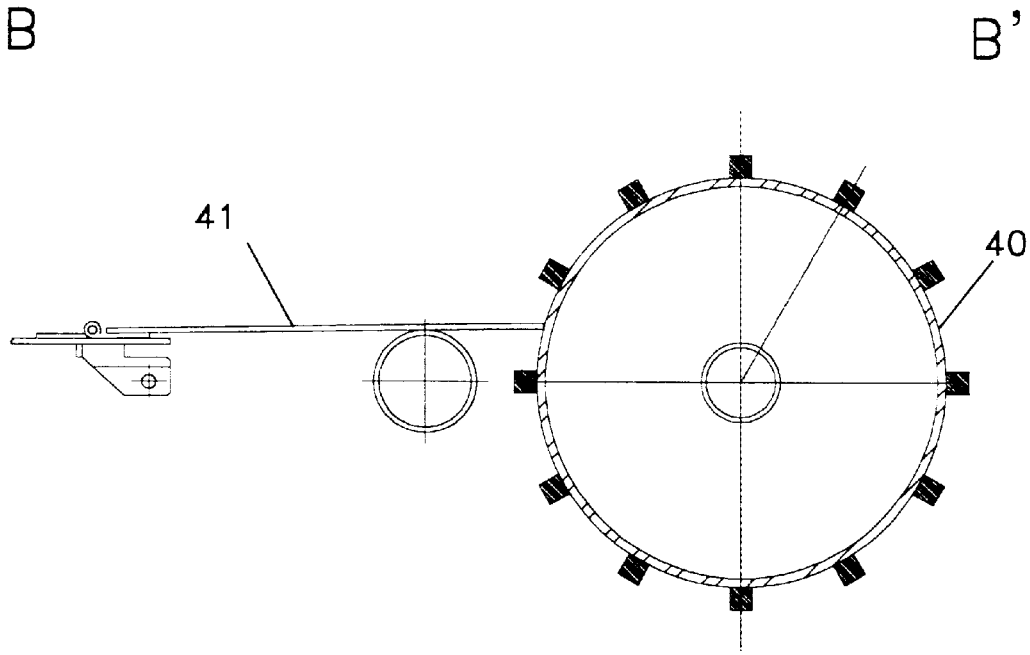
FIG. 8 is a second cross-sectional view of one embodiment of an ash roller, as viewed from the perspective of section B-B' of the embodiment of FIG. 2.

An ash discharge system (39), preferably comprising an ash roller (40), can be provided at the outlet end of grate assembly (14). Ash discharge system (39) may also comprise a discharge chute (36) and removal conveyor (38). The ash roller may serve to control the depth of material on the grate and may further aid in the removal of the materials from the grate system, including, but not limited to, combusted and uncombusted mass fuel, ash, and agglomerated combustion by-product. Thus the ash roller may additionally or alternatively serve to insure the desired or appropriate level of material, particularly that of mass fuel, in the combustion system. Ash roller (40) may, therefore, be adjustable to provide for the control of material removal from or of mass fuel level upon the grate assembly (14). As depicted in FIG. 8, an embodiment of the ash roller can comprise a pivotal plate (41) adjacent the ash roller to aid in the removal of ash and to further control the level of mass fuel upon the grate assembly. The conveyor (38) may be filled with water to prevent the undesired introduction of air into the combustion chamber through the ash discharge chute, among other purposes. Additionally, and according to some embodiments, an access door (42) may be provided for manual access to the lower combustion chamber (22). Ports (46) may further provide visual access to the lower combustion chamber.

Figure 5:
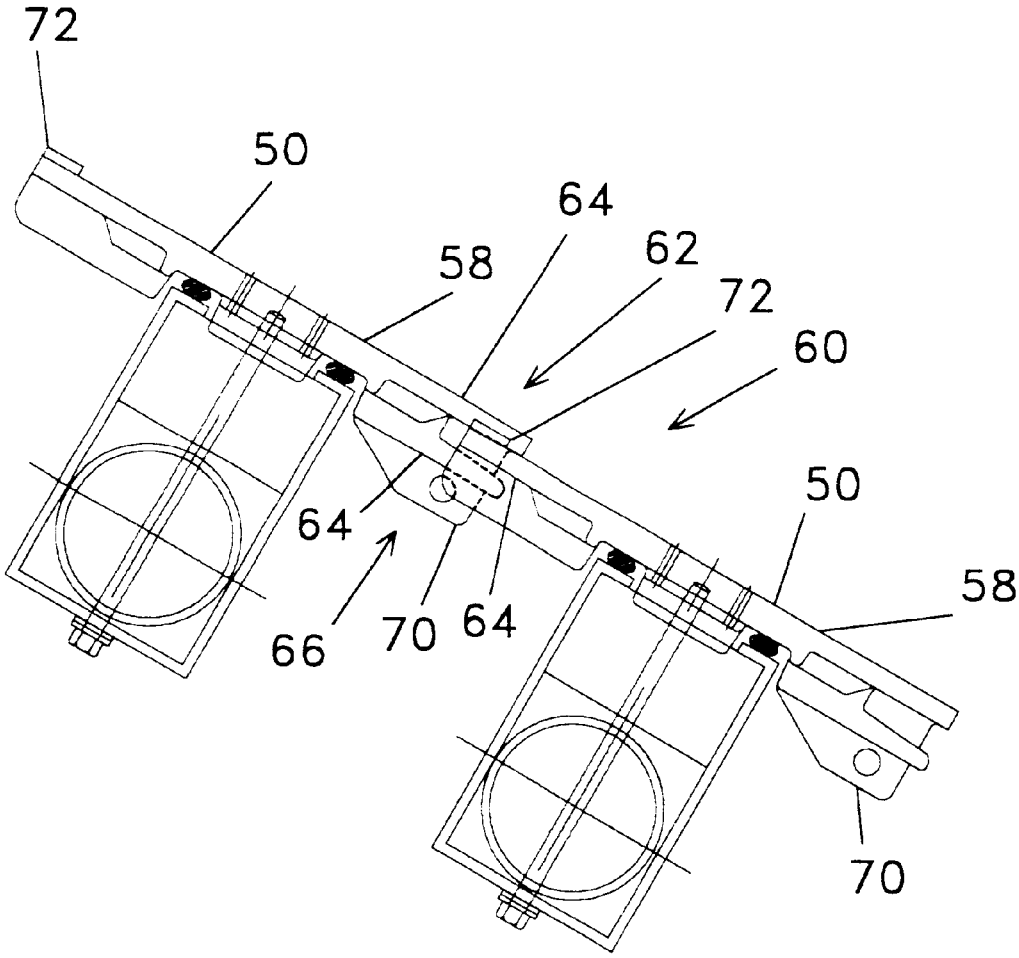
FIG. 5 is a cross-sectional view of one embodiment of grate assembly elements, particularly featuring two interconnected grate plates and associated header tubes, as viewed from the perspective of C-C' of the embodiment of FIG. 2.
Figure 12:
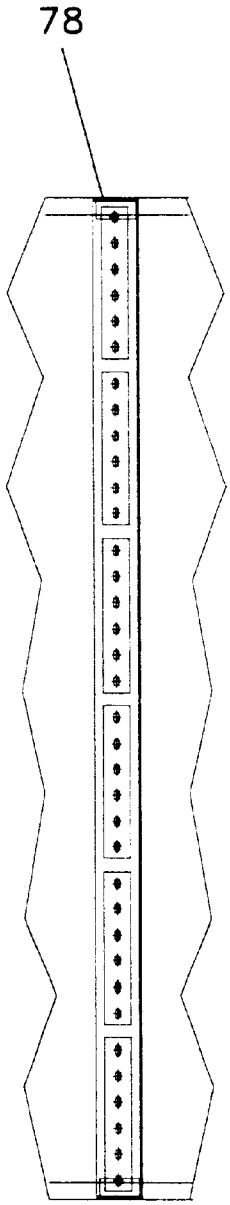
FIG. 12 is a plan view of one embodiment of a grate plate header assembly and associated supply plenums.
Figure 13:
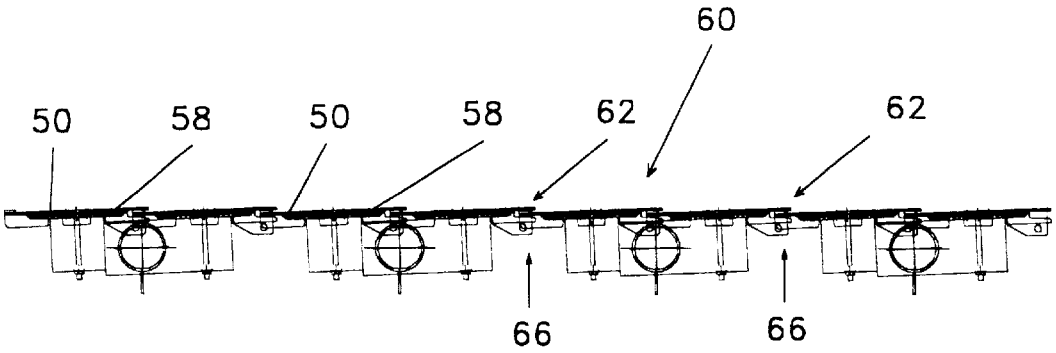
FIG. 13 is a cross-sectional view of one embodiment of grate assembly elements, particularly featuring a plurality of interconnected grate plates and associated header tubes, as viewed from the perspective of section D-D' of the embodiment of FIG. 2.

The grate system (14) may be provided in additional and preferred embodiments as depicted in FIGS. 2 through 5 and FIGS. 9 through 14. In particular, FIG. 2 provides a plan view of the grate assembly and ash roller (40). The grate assembly may, in preferred embodiments, be comprised of multiple grate elements or plates (50), each grate plate perhaps in an abutting position relative to adjacent width edges (52) of width-adjacent grate plates and in an overlapping relationship relative to length-adjacent grate plates. In this discussion, it may be helpful to understand that the terms "width" and "length" may define directions relative to the dimensions of the grate assembly (14). In particular, an in the depicted embodiment of FIGS. 2, 5 and 13, the grate plates overlap adjacent grate plates in the length direction of the assembly or in direction (54). Abutment of grate plates may occur along direction (56). Each grate plate may form a substantially planar surface (58) as depicted in FIGS. 5 and 13, and therefore, grate system or assembly (14) may have a substantially unobstructed planar surface (60) when the grate plates are connected. The substantially planar features of the grate assembly and plates may improve the combustion and migration of mass fuel by minimizing obstruction to the mass fuel.

In particular, and as depicted in FIGS. 5 and 13, grate elements or plates (50) interconnect such that an overlap (62) may exist between adjacent plates. The interconnect between plates may also be made via overlapping segments (64) such that, when overlapping segments are connected, an interlock system (66) is provided. Each grate plate may preferably be provided with integral tabs (68) to aid in interlocking or connecting adjacent plates as well as perhaps cooling. The interlock system may serve to maintain or hold the planar surface (60) of the grate assembly and thereby preventing substantial non-planar movement of the grate plates. The grate elements (50) may further comprise, according to a preferred embodiment, integral ribs or supports (70) that may serve to provide structural rigidity to the grate assembly and grate plates and may provide a means of cooling the grate assembly. Overlap spacers or spacer elements (72) may be provided integral to said grate plates to establish a space between the overlapping segments (64) of adjacent grate plates.

A space may, therefore, be created between overlapping segments, therefore allowing a gas flow through the overlapping section of grate plates. The gas introduced between spaces of overlapping grate plates can be primarily combustion gas introduced from the combustion gas feeds or plenums (26), via inlets (28). Other gases may be introduced through the space or gap between grate plates, including but not limited to grate cooling gases preferably introduced as recycled combusted gas through inlet 30. Inlets (28) and (30) of each plenum may be controlled in an independent manner relative to other combustion gas feeds or plenums, a multiple of plenums being depicted in a preferred embodiment of FIG. 1. Preferably, the control of combustion or recycled combusted gases may be automatically controlled via automatic control valves, poppets, dampers or other suitable means that may vary the flow or velocity over time.

In one embodiment, the introduction of combustion gas, mix gas, a secondary gas, two gases, or even recycled combusted gas may be made through the plenums such as plenums (26) in a pulsed fashion, via automatic control valves or poppets associated with individual inlets (28) and (30). Therefore, and given a plurality of combustion gas feed or to plenums (26) placed along the grate assembly (14) as depicted in FIG. 1, zones or sections of the grate assembly may be independently controlled, for example and not by way of limitation, for combustion or for grate cooling.

According to one embodiment, and as depicted in FIGS. 6, 9, 10 and 14, each grate plate (50) may include inlets, nozzles, or apertures (74) for introducing a secondary, mix, or agitating gas to the top surface of the grate or to material thereupon. More particularly, and according to a preferred embodiment, a secondary, mix, or agitation gas may be introduced through secondary gas feeds or plenums such as plenums (76). Plenums (76) may be in fluid communication with combustion gas feeds or plenums (26) so as to provide the same type of gas. Alternatively, the secondary gas feeds may provide a distinct gas supply. Furthermore, and according to one embodiment, secondary or agitation gas may be introduced from the secondary gas feeds or plenums (76) to secondary or agitation gas headers (78) via a plurality of introducing elements, or preferably, poppets (44). Gas headers (78) may be attached to an underside of grate plates (50) via bolts and bolt holes (79). Preferably, an individual poppet may be actuated to close a header supply tube (80) or gas housing (93). Each poppet (44) may be controlled in an independent manner relative to other poppets, a multiple of poppets depicted in a preferred embodiment of FIG. 1.

Figure 6:
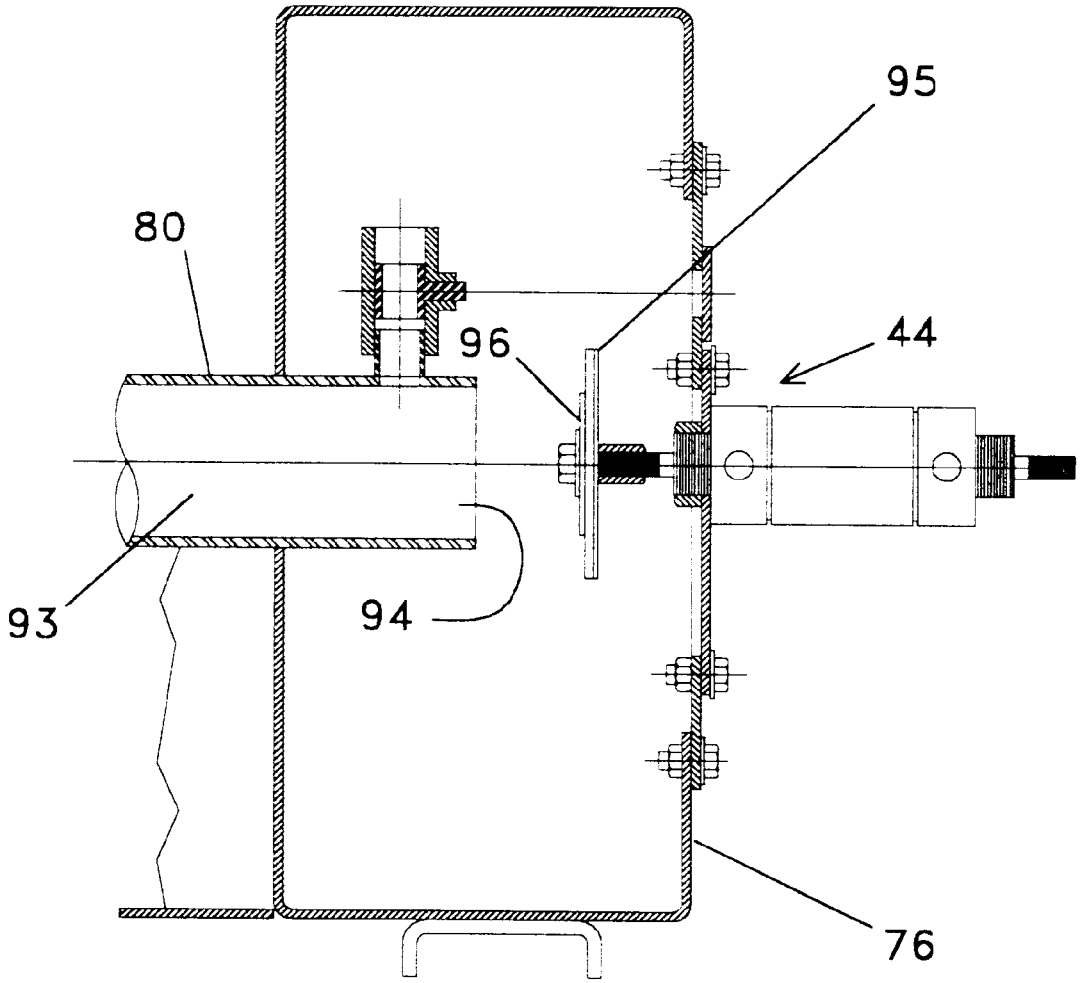
FIG. 6 is a cross-sectional view of one embodiment of a poppet assembly, supply plenum and header tube.
Figure 7:
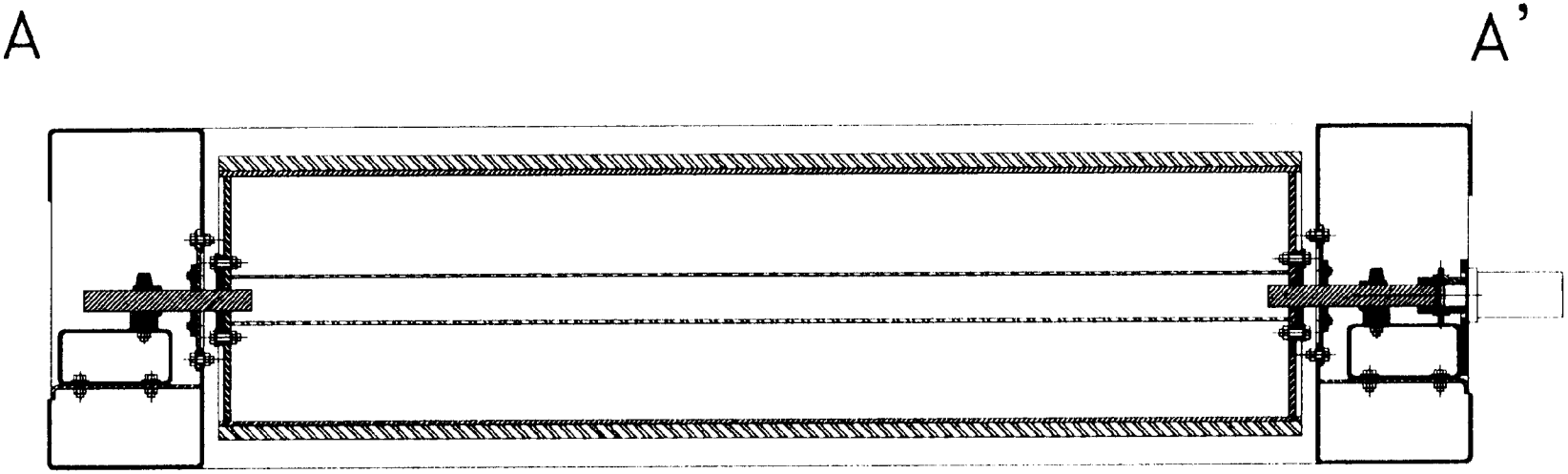
FIG. 7 is a cross-sectional view of one embodiment of an ash roller, as viewed from the perspective of section A-A' of the embodiment of FIG. 2.

As shown in FIG. 6, each poppet (44) may also include a gas housing (93) having an open end (94). Operating at the open end (94) of the gas housing (93) may be a controllable cap (95) to permit a gas pulse to occur by moving and opening the end of the gas housing (93). As shown, the operation of the controllable cap (95) may be made externally through some type of connection whether mechanical, electrical, or otherwise. To aid in sealing the poppet (44) it may include a seal (96) on either the controllable cap (95) or the gas housing (93) as can be easily appreciated. The seal (96) may also be made of an appropriate material, such as an elastomer or even Viton ™ to withstand the potentially harsh environment at the location of the poppet (44). Preferably, the control of secondary, mix, or even agitation gases may be automatically controlled via the poppets, wherein the secondary or agitation gas flow or velocity from zones or sections of apertures (74) of particular grates (50) preferably may vary as needed for proper combustion.

Figure 14:
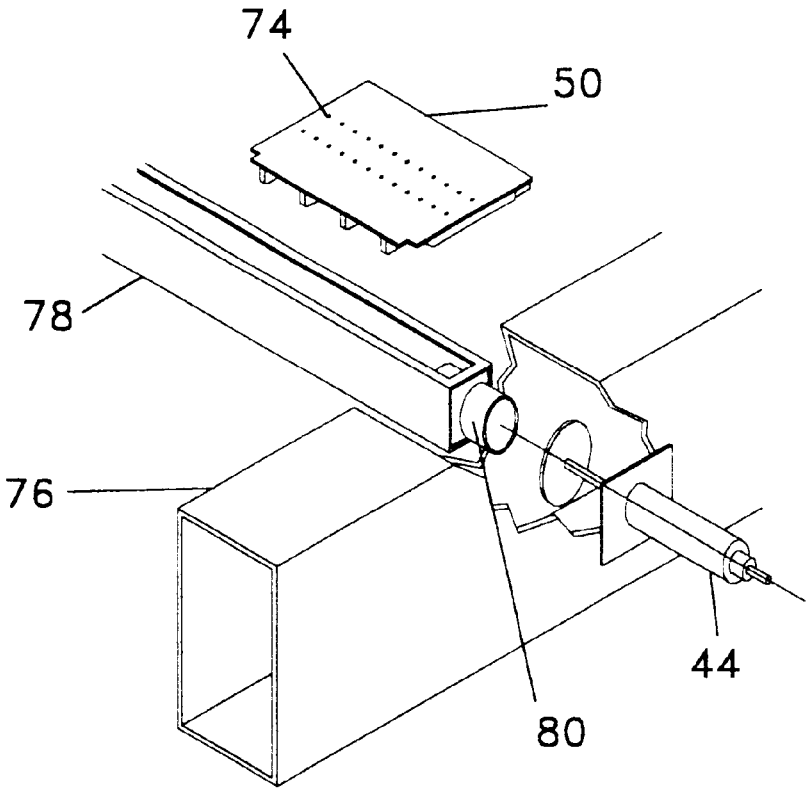
FIG. 14 is a perspective, partially open, grate assembly diagrammatic view of one embodiment of the invention.

In addition, the introduction of secondary or agitation gas may be made through the plenums (26) in a pulsed fashion, preferably via automatic control of poppets (44) associated with individual gas headers (78). Pulsed gas may provide for the most efficient agitation and other secondary gas functions, including, but not limited to, transportation, cooling and drying of the grate assembly and materials thereupon. Gas headers (78) insure a consistent and controlled flow of gas to sets of apertures (74). FIGS. 12 and 14 depict a preferred embodiment where one header may be in fluid communication with a single poppet (44). However, it is well within the scope of the present invention to provide multiple gas headers (78), associated with a single or multiple poppets, to provide gas flow to a set or zone or section of apertures (74) of particular grates (50). According to a preferred embodiment, therefore, zones or sections of grates may be supplied with automatically controlled secondary or agitation gas. Therefore, and given a preferred plurality of poppets (44) placed along the grate assembly (14) as depicted in FIG. 1, zones or sections of the grate assembly may be independently controlled, for example and not by way of limitation, for combustion or for grate cooling.

According to one embodiment, the pulsed introduction of a secondary gas may be independent of the combustion gas feeds or of any gas introduced from the combustion gas feeds or plenums (26). The introduction of combustion gas, including pulsed introduction, may likewise be independent of the secondary or agitation gas plenums (76) and poppets (44). Therefore, multiple pulsing systems, and multiple control of the pulsing systems, for gas introduction may function within the combustion system of the present invention.

According to another embodiment, the combustion system or furnace may comprise a vibration system (90) as generally depicted in FIG. 1. The vibration system (90) may also serve to provide agitation of ash and agglomerated combustion by-product or even slag present on the grate assembly (14) and to further aid in transportation of material along the grate assembly. Additionally, the vibration of mass fuel upon the grate assembly may further provide additional exposure of fuel, through agitation, to combustion.

Figure 9:
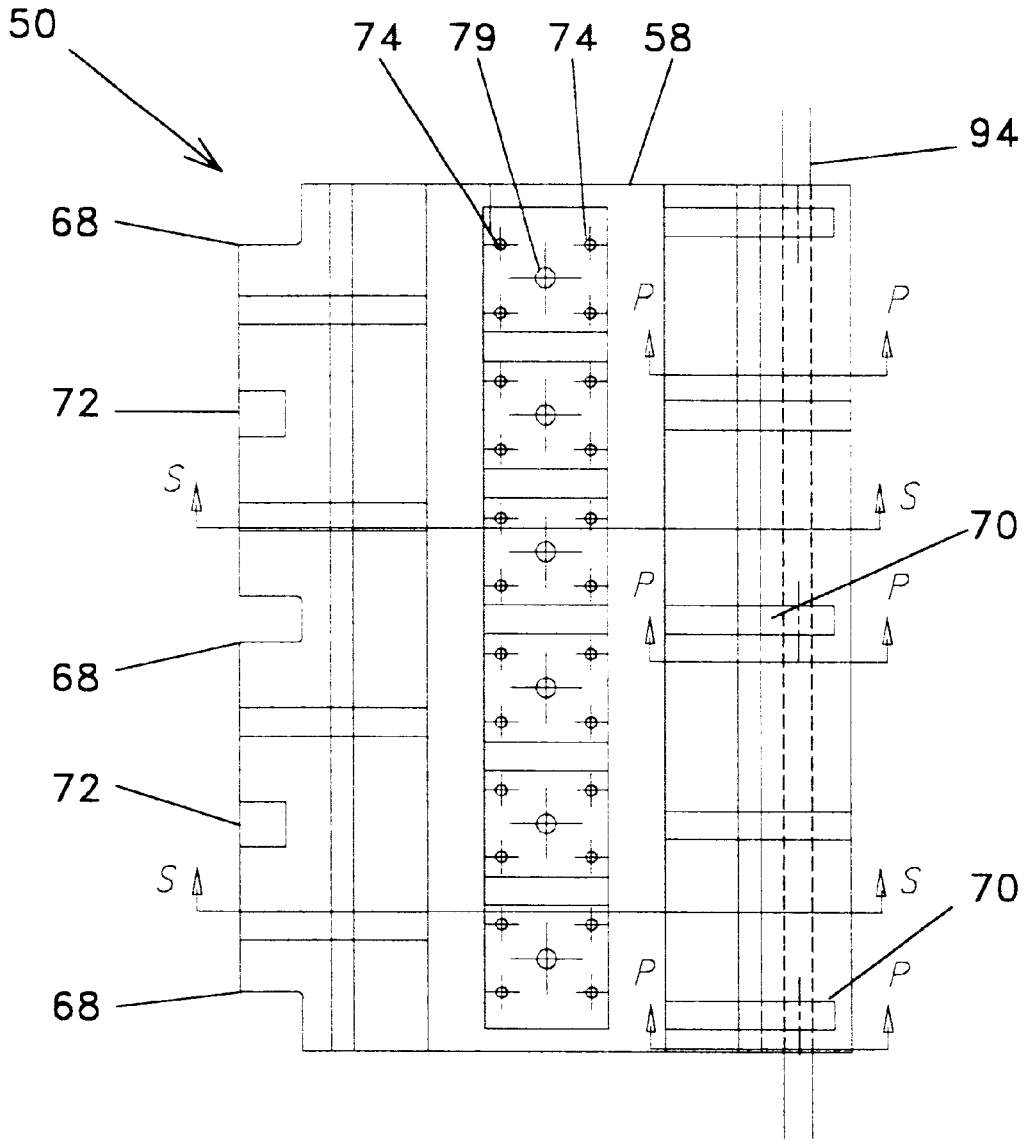
FIG. 9 is a plan view of one embodiment of one grate plate and supporting ribs, header connections and agitation gas apertures.
Figure 10:
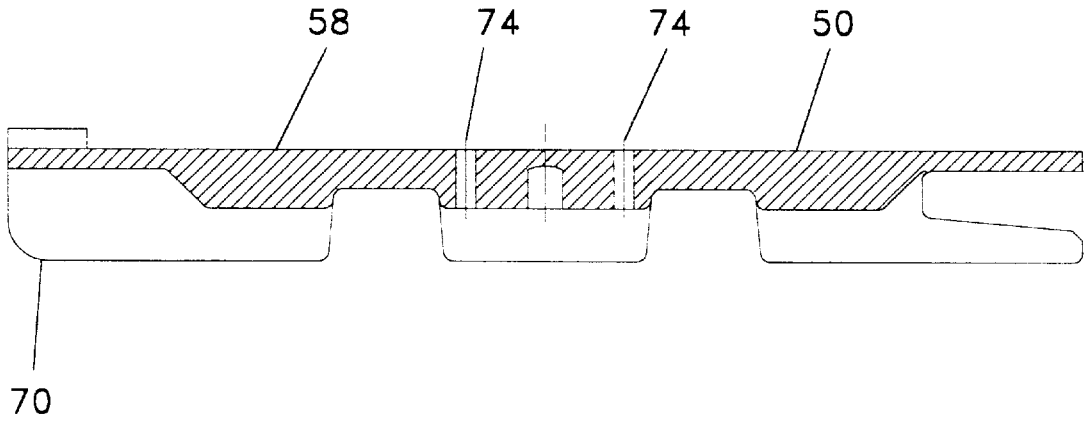
FIG. 10 is a cross-sectional view of the embodiment of the grate plate, supporting ribs, header connections and agitation gas apertures as depicted in FIG. 9, as viewed from the perspective of section S-S'.
Figure 11:
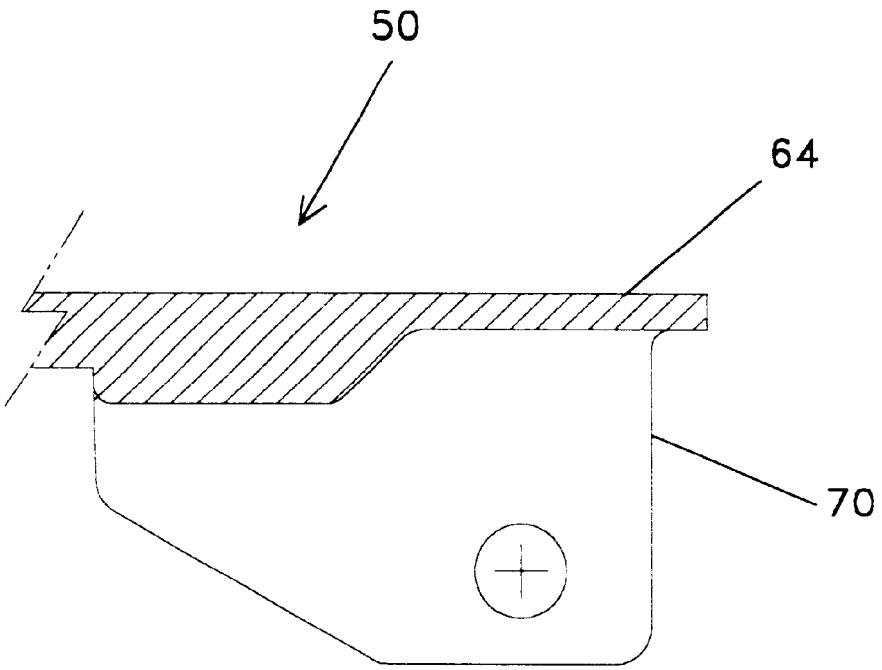
FIG. 11 is a cross-sectional view of the embodiment of the grate plate and supporting ribs as depicted in FIG. 9, as viewed from the perspective of P-P'.

Vibration system (90) may be comprised of a single or multiple vibration elements (92), such as in the form of typical oscillation or vibration devices. The vibration elements may be directly connected to the grate assembly (14) or may be operationally connected to the grate assembly via vibration interconnect elements. According to one embodiment, the vibration element or elements (92) may be connected to zones or portions of grate elements or plates (50) via a vibration interconnect rod (94), as depicted in FIG. 9, running the width of either single or multiple grate plates (50) through ribs (70). Accordingly, multiple sections or zones may be vibrated such as to remove agglomerated combustion by-product and to transport ash and agglomerated combustion by-product along the grate assembly. Each zone or portion of the grate assembly (14) or each zone or portion or each grate plate (50) of a plurality of grate plates or elements may be independently vibrated via vibration elements (92). Alternatively, one vibration element (92) may vibrate either the entire grate assembly (14) or an individual zone or portion of grate assembly (14) or an individual zone or portion or individual grate element (50).

According to one embodiment incorporating multiple vibration elements, the vibration system (90) can provide for the independent control of vibration for each vibration element (92) and also for each zone or portion of the grate assembly or grate plates, or of each individual grate plate. Therefore, individual elements, plates, zones or portions of the grate assembly or plurality of grate plates may be independently vibrationally responsive to vibratory movements of the vibration system.

Furthermore, an object of the present invention can be to provide for optimum combustion control of the combustion system. Therefore, a combustion control system (100) may be provided to monitor and control various operational parameters of the combustion system. Temperature sensors may be provided to monitor temperature(s) in the combustion chamber. The control system (100) may be individually responsive to single or multiple temperature sensors and may adjust operational parameters of the system within particular zones or portions of the combustion chamber relative to the grate assembly. In one embodiment a first temperature sensor or sensors may monitor combustion temperatures while a second temperature sensor or sensors may monitor post-combustion temperatures within the combustion chambers (20) and (22).

An additional embodiment of the combustion control system (100) may coordinate combustion parameters of the combustion system to optimize throughput and combustion efficiency. Each of these parameters may be controlled as is easily understood by those of ordinary skill in the art. Coordination of combustion parameters may provide for the control of various combustion system sub-components, such as, but not limited to those set forth in the claims and: mass fuel feed elements (18) and (20); combustion gas feed via plenums (26) and inlets (28) and (32); secondary or agitation gas feed via feed (34), plenums (76) and poppets (34); and post-combustion or recycled combusted gas feeds via inlets (30) and (42), such as but not limited to serving as a cooling or ash and agglomerated combustion by-product reduction system; and any combinations or permutations of such described systems. Monitored combustion parameters within the combustion chambers may comprise, but are not limited to: oxygen content, combustion gas oxygen content, carbon monoxide content, combustion gas carbon monoxide content, temperature, combustion temperature, post-combustion temperature, the relation between a fuel feed rate and a combustion gas feed rate, fuel migration rate, fuel bed depthand any combinations or permutations of such parameters. Parameters may be automatically controlled through programming or other automation as would be readily understood.

As part of controlling the overall combustion process, in introducing the mass fuel to the system it may be desirable to restrict or limit the amount of air introduced with the fuel itself. Thus, a low air fuel feed may be provided so that the amount of air introduced with the fuel is not the typical amount such as would be introduced when a typical often open air feed apparatus would be operated. This can be accomplished by providing doors or the like which limit open air exposure.

Similarly, a third gas feed situated at any location but likely most effective if positioned after combustion has occurred may be provided. This third gas feed can be used to independently control temperature. It may be configured to use recycled or even combusted gas and may feed such either above or below the grate system (14). This temperature control gas may serve as a cooling gas, of course.

The foregoing discussion and the claims that follow describe only some embodiments of the present invention. Particularly with respect to the claims, it should be understood that a number of changes may be made without departing from the essence of the present invention. In this regard, it is intended that such changes—to the extent that they substantially achieve the same results in substantially the same way—will still fall within the scope of the present invention.

As mentioned earlier, this invention can be embodied in a variety of ways. In addition, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all action may be expressed as a means for taking that action or as an element which causes that action. Similarly, each physical element disclosed should be understood to encompass a disclosure of the action which that physical element facilitates. Regarding this last aspect, as an example, the disclosure of a "feed" should be understood to encompass disclosure of the act of "feeding"—whether explicitly discussed or not—and, conversely, were there only disclosure of the act of "feeding", such a disclosure should be understood to encompass disclosure of a "feed" or even a "means for feeding". Such changes and alternative terms are to be understood to be explicitly included in the description.

It is simply not practical to describe in the claims all the possible embodiments to the present invention which may be accomplished generally in keeping with the goals and objects of the present invention and this disclosure and which may include separately or collectively such aspects. All elements set forth or claimed may be combined and claimed in any permutaton or combination. Further, while elements may be added to explicitly include such details, the existing claims should be construed to encompass such aspects. To the extent the methods claimed in the present invention are not further discussed, they are natural outgrowths of the system or apparatus claims. Furthermore, the steps are organized in a more logical fashion; however, other sequences can and do occur.

Therefore, the method claims should not be construed to include only the order of the sequence and steps presented.

Finally, any references mentioned in the application for this patent as well as all references listed in any information disclosure originally filed with the application or the priority filing are hereby incorporated by reference. However, to the extent statements might be considered inconsistent with the patenting of this/these invention(s), such statements are expressly not to be considered as made by the applicants. In addition, unless the context requires otherwise, the word "comprise" or variations such as "comprising" or "comprises", should be understood to imply the inclusion of a stated element or step or group of elements or steps but not the exclusion of any other element or step or group of elements or steps.

What is claimed is:

1. A method of combusting a mass fuel comprising the steps of:

a. providing a combustion chamber positioned to receive a mass fuel;

b. providing an inclined grate system within said combustion chamber;

c. feeding a mass fuel to said inclined grate system;

d. substantially combusting said mass fuel; and e. vibrating at least a portion of said inclined grate system;

f. forming a combusted mass fuel; and g. agitating said combusted mass fuel as a result of said step of vibrating said inclined grate system, wherein said step of forming combusted mass fuel comprises the step of forming an agglomerated combustion by-product.

2. A method of combusting a mass fuel as described in 1 wherein said step of agitating said combusted mass fuel comprises the step of agitating said agglomerated combustion by-product.

3. A method of combusting a mass fuel as described in 2 and further comprising the step of removing said agglomerated combustion by-product from said combustion chamber.

4. A method of combusting a mass fuel as described in 3 and further comprising the step of repeating said steps of vibrating, agitating and removing.

5. A method of combusting a mass fuel as described in 4 wherein said step of removing comprises the step of removing said agglomerated combustion by-product from said combustion chamber during said repeated steps of vibrating and agitating.

6. A method of combusting a mass fuel as described in 1 and further comprising the step of repeating said steps of feeding, substantially combusting and forming.

7. A method of combusting a mass fuel as described in 6 wherein said step of agitating said combusted mass fuel comprises the step of agitating said agglomerated combustion by-product.

8. A method of combusting a mass fuel as described in 7 and further comprising the step of removing said agglomerated combustion by-product from said combustion chamber.

9. A method of combusting a mass fuel as described in 8 and further comprising the step of repeating said steps of vibrating, agitating and removing.

10. A method of combusting a mass fuel as described in 9 and further comprising the step of removing said agglomerated combustion by-product from said combustion chamber during said repeated steps of vibrating and agitating.

11. A method of combusting a mass fuel as described in 7 and further comprising the step of providing a plurality of vibration elements and wherein said step of vibrating comprises the step of vibrating at least a portion of said inclined grate system with said plurality of vibration elements.

12. A method of combusting a mass fuel as described in 11 wherein said step of providing a inclined grate system comprises the step of providing a plurality of grate elements responsive to said plurality of vibration elements.

13. A method of combusting a mass fuel as described in 12 wherein said step of vibrating comprises the step of vibrating at least a portion of said plurality of grate elements with each of said vibration elements.

14. A method of combusting a mass fuel as described in 12 wherein said step of providing a inclined grate system comprises the step of providing a plurality of interconnect elements to which a plurality of said grate elements are responsive.

15. A method of combusting a mass fuel as described in 14 wherein said step of vibrating comprises the step of vibrating at least a portion of said plurality of interconnect elements with each of said vibration elements.

16. A method of combusting a mass fuel comprising the steps of:

a. providing a combustion chamber positioned to receive a mass fuel;

b. providing an inclined grate system within said combustion chamber;

c. feeding a mass fuel to said inclined grate system;

d. substantially combusting said mass fuel;

e. vibrating at least a portion of said inclined grate system;

f. forming a combusted mass fuel; and g. agitating said combusted mass fuel as a result of said step of vibrating said inclined grate system;

wherein said inclined grate system has a length between said input end and said output end and wherein said step of agitating comprises agitatingly transporting said combusted mass fuel along said length of said grate system;

wherein said step of agitating further comprises the step of agitatingly removing combusted mass fuel from said combustion chamber; and wherein said step of forming combusted mass fuel comprises the step of forming agglomerated combustion by-product.

17. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas;

i. discharging said combustion product;

wherein said step of introducing a temperature control gas into said combustion chamber comprises the step of introducing a cooling gas into said combustion chamber;

wherein said step of introducing a cooling gas into said combustion chamber comprises the step of introducing recycled combusted gas into said combustion chamber.

18. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas; and i. discharging said combustion product;

wherein said step of introducing a temperature control gas into said combustion chamber comprises the step of introducing said temperature control gas at a location at which said combustion product exists;

wherein said step of introducing said temperature control gas at a location at which said combustion product exists comprises the steps of:

i. introducing said temperature control gas above said grate system; and ii. introducing said temperature control gas below said grate system.

19. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas; and i. discharging said combustion product;

wherein said step of feeding a mass fuel into said combustion chamber comprises the step of limiting the amount of air introduced into said combustion chamber with said mass fuel.

20. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control recycled gas within said combustion chamber;

h. controlling a temperature within said combustion chamber through said temperature control recycled gas; and i. discharging said combustion product, wherein said step of introducing a temperature control recycled gas into said combustion chamber comprises the step of introducing a substantially uncombustible recycled gas into said combustion chamber.

21. A method of combusting a mass fuel as described in claim 20 wherein said step of introducing a substantially uncombustible recycled gas into said combustion chamber comprises the step of introducing recycled combusted gas within said combustion chamber.

22. A method of combusting a mass fuel as described in claim 20 and further comprising the step of introducing a mix gas into said combustion chamber and wherein said step of introducing a mix gas into said combustion chamber is independent of both said steps of introducing a combustion gas into said combustion chamber and introducing a temperature control recycled gas into said combustion chamber.

23. A method of combusting a mass fuel as described in claim 20 wherein said step of introducing a temperature control recycled gas into said combustion chamber comprises the step of introducing a cooling gas into said combustion chamber.

24. A method of combusting a mass fuel as described in claim 23 wherein said step of introducing a cooling gas into said combustion chamber comprises the step of introducing recycled combusted gas into said combustion chamber.

25. A method of combusting a mass fuel as described in claim 20 wherein said step of introducing a temperature control recycled gas into said combustion chamber comprises the step of introducing said temperature control recycled gas at a location at which said combustion product exists.

26. A method of combusting a mass fuel as described in claim 25 wherein said step of introducing said temperature control recycled gas at a location at which said combustion product exists comprises the step of introducing said temperature control recycled gas above said grate system.

27. A method of combusting a mass fuel as described in claim 25 wherein said step of introducing said temperature control recycled gas at a location at which said combustion product exists comprises the step of introducing said temperature control recycled gas below said grate system.

28. A method of combusting a mass fuel as described in claim 20 wherein said step of feeding a mass fuel into said combustion chamber comprises the step of limiting the amount of air introduced into said combustion chamber with said mass fuel.

29. A method of combusting a mass fuel as described in claim 20 and further comprising the step of reducing agglomerated combustion by-product within said combustion chamber as a result of said step of combusting at least a portion of said mass fuel to produce a combustion product.

30. A method of combusting a mass fuel as described in claim 29 wherein said step of reducing agglomerated combustion by-product within said combustion chamber as a result of said step of combusting at least a portion of said mass fuel to produce a combustion product comprises the step of introducing an agglomerated combustion by-product reduction gas within said combustion chamber.

31. A method of combusting a mass fuel as described in claim 30 wherein said step of introducing an agglomerated combustion by-product reduction gas within said combustion chamber comprises the step of introducing recycled combusted gas within said combustion chamber.

32. A method of combusting a mass fuel as described in claim 20 and further comprising the step of pulsing at least one of said gases introduced within said chamber.

33. A method of combusting a mass fuel as described in claim 20 and further comprising the step of pulsing said temperature control recycled gas.

34. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas;

i. discharging said combustion product;

wherein said step of introducing a temperature control gas into said combustion chamber comprises the step of introducing a substantially uncombustible gas into said combustion chamber; and wherein said step of introducing a substantially uncombustible gas into said combustion chamber comprises the step of introducing recycled combusted gas within said combustion chamber.

35. A method of combusting a mass fuel comprising the steps of:

a. providing a combustion chamber positioned to receive a mass fuel;

b. providing an inclined grate system within said combustion chamber;

c. feeding a mass fuel to said inclined grate system;

d. substantially combusting said mass fuel;

e. vibrating at least a portion of said inclined grate system with a plurality of vibration elements;

f. independently controlling each of said plurality of vibration elements;

g. forming a combusted mass fuel;

h. agitating said combusted mass fuel as a result of said step of vibrating said inclined grate system; and i. forming uncombusted material when accomplishing said step of forming a combusted mass fuel.

36. A method of combusting a mass fuel as described in 35 and further comprising the step of agitating said uncombusted material as a result of said step of vibrating said inclined grate system.

37. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas;

i. discharging said combustion product; and j. introducing a mix gas into said combustion chamber and wherein said step of introducing a mix gas into said combustion chamber is independent of both said steps of introducing a combustion gas into said combustion chamber and introducing a temperature control gas into said combustion chamber.

38. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas;

i. discharging said combustion product; and j. reducing agglomerated combustion by-product within said combustion chamber and on said grate system as a result of said step of combusting at least a portion of said mass fuel to produce a combustion product.

39. A method of combusting a mass fuel as described in claim 38 wherein said step of reducing agglomerated combustion by-product within said combustion chamber as a result of said step of combusting at least a portion of said mass fuel to produce a combustion product comprises the step of introducing an agglomerated combustion by-product reduction gas within said combustion chamber.

40. A method of combusting a mass fuel as described in claim 39 wherein said step of introducing an agglomerated combustion by-product reduction gas within said combustion chamber comprises the step of introducing recycled combusted gas within said combustion chamber.

41. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a mix gas into said combustion chamber;

f. introducing a combustion gas into said combustion chamber;

g. independently pulsing said mix gas independent of said combustion gas;

h. mixing said mass fuel through action of said mix gas;

i. combusting at least a portion of said mass fuel to produce a combustion product; and j. discharging said combustion product.

42. A method of combusting a mass fuel as described in claim 41 and further comprising the step of independently pulsing said combustion gas independent of said mix gas.

43. A method of combusting a mass fuel as described in claim 41 and further comprising the steps of introducing a temperature control gas within said combustion chamber and controlling a temperature within said combustion chamber through said temperature control gas.

44. A method of combusting a mass fuel as described in claim 43 wherein said step of introducing a temperature control gas into said combustion chamber comprises the step of introducing a substantially uncombustible gas into said combustion chamber.

45. A method of combusting a mass fuel as described in claim 44 wherein said step of introducing a substantially uncombustible gas into said combustion chamber comprises the step of introducing recycled combusted gas within said combustion chamber.

46. A method of combusting a mass fuel as described in claim 43 wherein said step of introducing a mix gas into said combustion chamber is independent of both said steps of introducing a combustion gas into said combustion chamber and introducing a temperature control gas into said combustion chamber.

47. A method of combusting a mass fuel as described in claim 43 wherein said step of introducing a temperature control gas into said combustion chamber comprises the step of introducing a cooling gas into said combustion chamber.

48. A method of combusting a mass fuel as described in claim 47 wherein said step of introducing a cooling gas into said combustion chamber comprises the step of introducing recycled combusted gas into said combustion chamber.

49. A method of combusting a mass fuel as described in claim 43 wherein said step of introducing a temperature control gas into said combustion chamber comprises the step of introducing said temperature control gas at a location at which said combustion product exists.

50. A method of combusting a mass fuel as described in claim 49 wherein said step of introducing said temperature control gas at a location at which said combustion product exists comprises the step of introducing said temperature control gas above said grate system.

51. A method of combusting a mass fuel as described in claim 49 wherein said step of introducing said temperature control gas at a location at which said combustion product exists comprises the step of introducing said temperature control gas below said grate system.

52. A method of combusting a mass fuel as described in claim 41 wherein said step of feeding a mass fuel into said combustion chamber comprises the step of limiting the amount of air introduced into said combustion chamber with said mass fuel.

53. A method of combusting a mass fuel as described in claim 41 and further comprising the step of reducing agglomerated combustion by-product within said combustion chamber as a result of said step of combusting at least a portion of said mass fuel to produce a combustion product.

54. A method of combusting a mass fuel as described in claim 53 wherein said step of reducing agglomerated combustion by-product within said combustion chamber as a result of said step of combusting at least a portion of said mass fuel to produce a combustion product comprises the step of introducing an agglomerated combustion by-product reduction gas within said combustion chamber.

55. A method of combusting a mass fuel as described in claim 54 wherein said step of introducing an agglomerated combustion by-product reduction gas within said combustion chamber comprises the step of introducing recycled combusted gas within said combustion chamber.

56. A method of combusting a mass fuel as described in claim 41 and further comprising the step of pulsing said combustion gas.

57. A method of combusting a mass fuel as described in claim 43 and further comprising the step of pulsing said temperature control gas.

58. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas;

i. discharging said combustion product; and j. pulsing at least one of said gases introduced within said chamber.

59. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a combustion gas into said combustion chamber;

f. combusting at least a portion of said mass fuel to produce a combustion product;

g. introducing a temperature control gas within said combustion chamber independent of said step of introducing a combustion gas into said combustion chamber;

h. controlling a temperature within said combustion chamber through said temperature control gas;

i. discharging said combustion product; and j. pulsing said temperature control gas.

60. A method of combusting a mass fuel comprising the steps of:

a. providing a combustion chamber positioned to receive a mass fuel;

b. establishing a grate system within a combustion chamber;

c. feeding a mass fuel onto said grate system within said combustion chamber;

d. transporting said mass fuel across said grate system;

e. introducing a first gas within said combustion chamber;

f. introducing a second gas within said combustion chamber;

g. independently pulsing said first gas independent of said second gas;

h. independently pulsing said second gas independent of said first gas;

i. combusting at least a portion of said mass fuel to produce a combustion product; and j. discharging said combustion product.

61. A method of combusting a mass fuel as described in claim 60 wherein one of said steps e. and h. comprises introducing a temperature control gas within said combustion chamber and controlling a temperature within said combustion chamber through said temperature control gas.

62. A method of combusting a mass fuel as described in claim 61 wherein said step of introducing a temperature control gas into said combustion chamber comprises the step of introducing a substantially uncombustible gas into said combustion chamber.

63. A method of combusting a mass fuel as described in claim 62 wherein said step of introducing a substantially uncombustible gas into said combustion chamber comprises the step of introducing recycled combusted gas within said combustion chamber.

64. A method of combusting a mass fuel as described in claim 60 or 61 and further comprising the step of introducing a mix gas into said combustion chamber.

65. A method of combusting a mass fuel as described in claim 64 wherein said step of introducing a first gas comprises introducing a combustion gas into said combustion chamber and wherein said step of introducing a second gas comprises introducing a temperature control gas into said combustion chamber; wherein said step of introducing a mix gas is independent of both said steps of introducing a combustion gas and introducing a temperature control gas.

66. A method of combusting a mass fuel as described in claim 61 wherein said step of introducing a temperature control gas into said combustion chamber comprises the step of introducing a cooling gas into said combustion chamber.

67. A method of combusting a mass fuel as described in claim 66 wherein said step of introducing a cooling gas into said combustion chamber comprises the step of introducing recycled combusted gas into said combustion chamber.

68. A method of combusting a mass fuel as described in claim 61 wherein said step of introducing a temperature control gas into said combustion chamber comprises the step of introducing said temperature control gas at a location at which said combustion product exists.

69. A method of combusting a mass fuel as described in claim 68 wherein said step of introducing said temperature control gas at a location at which said combustion product exists comprises the step of introducing said temperature control gas above said grate system.

70. A method of combusting a mass fuel as described in claim 68 wherein said step of introducing said temperature control gas at a location at which said combustion product exists comprises the step of introducing said temperature control gas below said grate system.

71. A method of combusting a mass fuel as described in claim 60 wherein said step of feeding a mass fuel into said combustion chamber comprises the step of limiting the amount of air introduced into said combustion chamber with said mass fuel.

72. A method of combusting a mass fuel as described in claim 60 and further comprising the step of reducing agglomerated combustion by-product within said combustion chamber as a result of said step of combusting at least a portion of said mass fuel to produce a combustion product.

73. A method of combusting a mass fuel as described in claim 72 wherein said step of reducing agglomerated combustion by-product within said combustion chamber as a result of said step of combusting at least a portion of said mass fuel to produce a combustion product comprises the step of introducing an agglomerated combustion by-product reduction gas within said combustion chamber.

74. A method of combusting a mass fuel as described in claim 73 wherein said step of introducing an agglomerated combustion by-product reduction gas within said combustion chamber comprises the step of introducing recycled combusted gas within said combustion chamber.

75. A method of combusting a mass fuel comprising the steps of:

a. providing a combustion chamber positioned to receive a mass fuel;

b. overlapping a plurality of grate elements to establish a grate system within a combustion chamber comprising the steps of;

i. the step of establishing a substantially planar grate system within said combustion chamber; and ii. the step of overlapping a plurality of substantially planar grate elements to establish said substantially planar grate system within a combustion chamber;

c. establishing a plurality of spaces on said grate system as a result of said step of overlapping said plurality of overlapping grate elements;

d. providing a plurality of apertures on said plurality of overlapping grate elements;

e. feeding a mass fuel into said combustion chamber;

f. introducing a combustion gas through said plurality of spaces on said grate system;

g. introducing a secondary gas through said plurality of apertures on said plurality of overlapping grate elements within said combustion chamber;

h. transporting said mass fuel across said grate system;

i. combusting at least a portion of said mass fuel to produce a combustion product;

j. discharging said combustion product; and k. interlocking said plurality of grate elements within a combustion chamber.

76. A method of combusting a mass fuel as described in claim 75 and further comprising the step of restricting said plurality of grate elements within a planar surface.

77. A method of combusting a mass fuel as described in claim 75 and further comprising the step of dissipating heat through at least one integral rib on said plurality of grate elements.

78. A method of combusting a mass fuel comprising the steps of:

a. providing a combustion chamber positioned to receive a mass fuel;

b. overlapping a plurality of grate elements to establish a grate system within a combustion chamber;

c. establishing a plurality of spaces on said grate system as a result of said step of overlapping said plurality of overlapping grate elements;

d. providing a plurality of apertures on said plurality of overlapping grate elements;

e. feeding a mass fuel into said combustion chamber;

f. introducing a combustion gas through said plurality of spaces on said grate system;

g. introducing a secondary gas through said plurality of apertures on said plurality of overlapping grate elements within said combustion chamber;

h. transporting said mass fuel across said grate system;

i. combusting at least a portion of said mass fuel to produce a combustion product;

j. discharging said combustion product; and k. pulsing said combustion gas.

79. A method of combusting a mass fuel comprising the steps of:

a. providing a combustion chamber positioned to receive a mass fuel;

b. overlapping a plurality of grate elements to establish a grate system within a combustion chamber;

c. establishing a plurality of spaces on said grate system as a result of said step of overlapping said plurality of overlapping grate elements;

d. providing a plurality of apertures on said plurality of overlapping grate elements;

e. feeding a mass fuel into said combustion chamber;

f. introducing a combustion gas through said plurality of spaces on said grate system;

g. introducing a secondary gas through said plurality of apertures on said plurality of overlapping grate elements within said combustion chamber;

h. transporting said mass fuel across said grate system;

i. combusting at least a portion of said mass fuel to produce a combustion product;

j. discharging said combustion product; and k. pulsing said secondary gas;

wherein said step of introducing a secondary gas through said plurality of apertures on said plurality of overlapping grate elements within said combustion chamber comprises the step of distributing said secondary air through a plenum below each of said overlapping grate elements.

80. A method of combusting a mass fuel as described in claims 79 wherein said step of pulsing said secondary gas comprises the step of pulsing said secondary gas independent of said combustion gas.

81. A method of combusting a mass fuel comprising the steps of:

a. providing a combustion chamber positioned to receive a mass fuel;

b. overlapping a plurality of grate elements to establish a grate system within a combustion chamber;

c. establishing a plurality of spaces on said grate system as a result of said step of overlapping said plurality of overlapping grate elements;

d. providing a plurality of apertures on said plurality of overlapping grate elements;

e. feeding a mass fuel into said combustion chamber;

f. introducing a combustion gas through said plurality of spaces on said grate system;

g. introducing a secondary gas through said plurality of apertures on said plurality of overlapping grate elements within said combustion chamber;

h. transporting said mass fuel across said grate system;

i. combusting at least a portion of said mass fuel to produce a combustion product;

j. discharging said combustion product; and k. actively controlling a level at which said step of combusting at least a portion of said mass fuel to produce a combustion product is accomplished while said step of combusting at least a portion of said mass fuel to produce a combustion product is accomplished;

wherein said step of actively controlling a level at which said step of combusting at least a portion of said mass fuel to produce a combustion product is accomplished while said step of combusting at least a portion of said mass fuel to produce a combustion product is accomplished comprises the step of sensing a temperature in said combustion chamber;

wherein said step of sensing a temperature in said combustion chamber comprises the step of:

a. sensing a first temperature in said combustion chamber; and b. sensing a second temperature in said combustion chamber; and wherein said step of sensing a first temperature in said combustion chamber comprises the step of sensing a combustion temperature in said combustion chamber, and wherein said step of sensing a second temperature in said combustion chamber comprises the step of sensing a post-combustion temperature in said combustion chamber.

82. A method of combusting a mass fuel comprising the steps of:

a. providing a combustion chamber positioned to receive a mass fuel;

b. overlapping a plurality of grate elements to establish a grate system within a combustion chamber;

c. establishing a plurality of spaces on said grate system as a result of said step of overlapping said plurality of overlapping grate elements;

d. providing a plurality of apertures on said plurality of overlapping grate elements;

e. feeding a mass fuel into said combustion chamber;

f. introducing a combustion gas through said plurality of spaces on said grate system;

g. introducing a secondary gas through said plurality of apertures on said plurality of overlapping grate elements within said combustion chamber;

h. transporting said mass fuel across said grate system;

i. combusting at least a portion of said mass fuel to produce a combustion product;

j. discharging said combustion product;

k. controlling a depth of said mass fuel on said grate system by operation of a roller at an output end of said grate system;

wherein said step of controlling a depth of said mass fuel on said grate system by operation of a roller at an output end of said grate system comprises the step of adjusting said roller.

83. A method of combusting a mass fuel comprising the steps of:

a. providing a combustion chamber positioned to receive a mass fuel;

b. overlapping a plurality of grate elements to establish a grate system within a combustion chamber;

c. establishing a plurality of spaces on said grate system as a result of said step of overlapping said plurality of overlapping grate elements;

d. providing a plurality of secondary gas apertures on said plurality of overlapping grate elements;

e. feeding a mass fuel into said combustion chamber;

f. introducing a combustion gas through said plurality of spaces on said grate system;

g. introducing a secondary gas through said plurality of secondary gas apertures on said plurality of overlapping grate elements within said combustion chamber;

h. transporting said mass fuel across said grate system;

i. combusting at least a portion of said mass fuel to produce a combustion product;

j. discharging said combustion product;

k. establishing a secondary gas pulse system to which said secondary gas is responsive; and l. vibrating at least a portion of said grate system.

84. A method of combusting a mass fuel as described in claim 83 further comprising the step of providing a plurality of vibration elements and wherein said step of vibrating comprises the step of independently controlling each of said plurality of vibration elements.

85. A method of combusting a mass fuel comprising the steps of:

a. providing a combustion chamber positioned to receive a mass fuel;

b. overlapping a plurality of grate elements to establish a grate system within a combustion chamber;

c. establishing a plurality of spaces on said grate system as a result of said step of overlapping said plurality of overlapping grate elements;

d. providing a plurality of apertures on said plurality of overlapping grate elements;

e. feeding a mass fuel into said combustion chamber;

f. introducing a combustion gas through said plurality of spaces on said grate system;

g. introducing a secondary gas through said plurality of apertures on said plurality of overlapping grate elements within said combustion chamber;

h. transporting said mass fuel across said grate system;

i. combusting at least a portion of said mass fuel to produce a combustion product;

j. discharging said combustion product;

k. introducing a third gas at a location at which said combustion product exists;

l. actively controlling a level at which said step of combusting at least a portion of said mass fuel to produce a combustion product is accomplished while said step of combusting at least a portion of said mass fuel to produce a combustion product is accomplished;

wherein said step of actively controlling a level at which said step of combusting at least a portion of said mass fuel to produce a combustion product is accomplished while said step of combusting at least a portion of said mass fuel to produce a combustion product is accomplished comprises the step of sensing a temperature in said combustion chamber;

wherein said step of sensing a temperature in said combustion chamber comprises the step of:

a. sensing a first temperature in said combustion chamber; and b. sensing a second temperature in said combustion chamber;

wherein said step of sensing a first temperature in said combustion chamber comprises the step of sensing a combustion temperature in said combustion chamber, and wherein said step of sensing a second temperature in said combustion chamber comprises the step of sensing a post-combustion temperature in said combustion chamber.

86. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end and a length between said input end and said output end across which mass fuel is transported, wherein:

i. said plurality of overlapping grate elements further comprises an interlock system between at least two of said plurality of overlapping grate elements;

ii. said plurality of overlapping grate elements forms a substantially unobstructed planar surface; and iii. each of said plurality of overlapping grate elements comprises a substantially planar overlapping grate element; and d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of apertures within said plurality of overlapping grate elements for introducing a secondary gas from said secondary gas feed to said mass fuel transported across said length of overlapping grate elements; and h. an ash discharge system situated in the vicinity of said output end of said plurality of overlapping fixed grate elements.

87. A mass fuel combustion furnace as described in claim 86 wherein said interlock system comprises a planar restriction element.

88. A mass fuel combustion furnace as described in claim 86 wherein said interlock system comprises an integral tab on each of said plurality of overlapping grate elements.

89. A mass fuel combustion furnace as described in claim 86 and further comprising a plurality of integral ribs which are integral to at least one of said plurality of overlapping grate elements.

90. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end and a length between said input end and said output end across which mass fuel is transported;

d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of apertures within said plurality of overlapping grate elements for introducing a secondary gas from said secondary gas feed to said mass fuel transported across said length of overlapping grate elements;

h. an ash discharge system situated in the vicinity of said output end of said plurality of overlapping fixed grate elements; and i. a gas pulse system to which said combustion air is responsive;

wherein said combustion gas comprises combustion air.

91. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end and a length between said input end and said output end across which mass fuel is transported;

d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of apertures within said plurality of overlapping grate elements for introducing a secondary gas from said secondary gas feed to said mass fuel transported across said length of overlapping grate elements;

h. an ash discharge system situated in the vicinity of said output end of said plurality of overlapping fixed grate elements;

i. a secondary gas plenum adjacent at least one of said overlapping grate elements and which is responsive to said secondary gas feed; and j. a secondary gas pulse system to which said secondary gas is responsive.

92. A mass fuel combustion furnace as described in claim 91 wherein said secondary gas pulse system comprises at least one poppet element to which said secondary gas plenum is responsive.

93. A mass fuel combustion furnace as described in claim 92 wherein said poppet element to which said secondary gas plenum is responsive comprises:

a. a gas housing having an end opening;

b. a controllable cap positioned adjacent said end opening of said gas housing; and c. a seal positioned between said end opening of said gas housing and said controllable cap.

94. A mass fuel combustion furnace as described in claim 92 wherein said combustion gas feed is independent of said secondary gas pulse system.

95. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end and a length between said input end and said output end across which mass fuel is transported;

d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of secondary gas apertures within said plurality of overlapping grate elements for introducing a secondary gas from said secondary gas feed through said mass fuel transported across said length of overlapping grate elements;

h. an ash discharge system situated in the vicinity of said output end of said plurality of overlapping fixed grate elements;

i. a combustion control system;

j. at least one temperature sensor responsive to conditions within said combustion chamber and to which said combustion control system is responsive; and k. a secondary gas pulse system to which said secondary gas is responsive.

96. A mass fuel combustion furnace as described in claim 95 wherein said at least one temperature sensor responsive to conditions within said combustion chamber and to which said combustion control system is responsive comprises:

a. a first temperature sensor responsive to conditions within said combustion chamber and to which said combustion control system is responsive; and b. a second temperature sensor responsive to conditions within said combustion chamber and to which said combustion control system is also responsive.

97. A mass fuel combustion furnace as described in claim 96 wherein said first temperature sensor responsive to conditions within said combustion chamber and to which said combustion control system is responsive comprises a combustion temperature sensor and wherein said second temperature sensor is responsive to conditions within said combustion chamber and to which said combustion control system is also responsive comprises a post-combustion temperature sensor.

98. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end, a length between said input end and said output end across which mass fuel is transported d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of secondary gas apertures within said plurality of overlapping grate elements for introducing a secondary gas from said secondary gas feed through said mass fuel transported across said length of overlapping grate elements;

h. an ash discharge system situated in the vicinity of said output end of said plurality of overlapping fixed grate elements;

i. a combustion control system; and k. a secondary gas pulse system to which said secondary gas is responsive, wherein said combustion control system comprises a combustion parameter coordination system.

99. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end and a length between said input end and said output end across which mass fuel is transported;

d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of secondary gas apertures within said plurality of overlapping grate elements for introducing a secondary gas from said secondary gas feed through said mass fuel transported across said length of overlapping grate elements;

h. an ash discharge system situated in the vicinity of said output end of said plurality of overlapping fixed grate elements;

i. a secondary gas pulse system to which said secondary gas is responsive; and k. a combustion control system wherein said combustion control system;

i. has responsive to it a system selected from the group consisting of: said mass fuel feed element, said combustion gas feed, said secondary gas feed, said post-combustion gas feed, said ash discharge system, a chamber cooling system, a chamber cooling gas feed, said ash discharge system, a rate of transport system, a vibration system, a grate vibration system, a roller element, and any combinations or permutations of such systems; and ii. comprises a control system responsive to a combustion parameter selected from the group consisting of: oxygen content, carbon monoxide content, furnace pressure, temperature, combustion temperature, post-combustion temperature, the relation between a fuel feed rate and a combustion gas feed rate, and any combinations or permutations of such parameters.

100. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end and a length between said input end and said output end across which mass fuel is transported;

d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of secondary gas apertures within said plurality of overlapping grate elements for introducing a secondary gas from said secondary gas feed through said mass fuel transported across said length of overlapping grate elements;

h. an ash discharge system situated in the vicinity of said output end of said plurality of overlapping fixed grate elements; and i. a secondary gas pulse system to which said secondary gas is responsive, wherein said ash discharge system comprises a roller; and wherein said roller comprises an adjustable roller to which an amount of fuel on said grate system is responsive.

101. A mass fuel combustion furnace comprising:

a. a mass fuel feed element;

b. a combustion chamber positioned to receive mass fuel from said mass fuel feed element;

c. a plurality of overlapping grate elements within said combustion chamber and establishing an input end, an output end and a length between said input end and said output end across which mass fuel is transported;

d. a combustion gas feed within said combustion chamber;

e. a plurality of overlapping segments of said plurality of overlapping grate elements forming a space between each pair of overlapping segments, wherein said combustion gas feed is positioned for introducing combustion gas through said plurality of spaces;

f. a secondary gas feed within said combustion chamber;

g. a plurality of apertures within said plurality of overlapping grate elements for introducing a secondary gas from said secondary gas feed to said mass fuel transported across said length of overlapping grate elements;

h. an ash discharge system situated in the vicinity of said output end of said plurality of overlapping fixed grate elements; wherein said ash discharge system comprises:

i. a roller; and ii. a pivotable plate positioned adjacent said roller.

102. A mass fuel combustion furnace comprising:

a. a mass fuel feed element;

b. a combustion chamber positioned to receive mass fuel from said mass fuel feed element;

c. a grate system within said combustion chamber and having an input end and an output end across which said mass fuel is transported;

d. a combustion gas feed within said combustion chamber;

e. a temperature control gas feed within said combustion chamber independent of said combustion gas feed;

f. an ash discharge system situated in the vicinity of said output end of said grate system; and g. a fuel mix gas feed within said combustion chamber and wherein said temperature control gas feed within said combustion chamber comprises a temperature control gas feed which is independent of both said combustion gas feed and said fuel mix gas feed.

103. A mass fuel combustion furnace comprising:

a. a mass fuel feed element;

b. a combustion chamber positioned to receive mass fuel from said mass fuel feed element;

c. a grate system within said combustion chamber and having an input end and an output end across which said mass fuel is transported;

d. a combustion gas feed within said combustion chamber;

e. a temperature control gas feed within said combustion chamber independent of said combustion gas feed; and f. an ash discharge system situated in the vicinity of said output end of said grate system;

wherein said temperature control gas feed within said combustion chamber comprises a cooling gas feed; and wherein said cooling gas feed comprises a recycled gas feed.

104. A mass fuel combustion furnace comprising:

a. a mass fuel feed element;

b. a combustion chamber positioned to receive mass fuel from said mass fuel feed element;

c. a grate system within said combustion chamber and having an input end and an output end across which said mass fuel is transported;

d. a combustion gas feed within said combustion chamber;

e. a temperature control gas feed within said combustion chamber independent of said combustion gas feed; and f. an ash discharge system situated in the vicinity of said output end of said grate system;

wherein said temperature control gas feed within said combustion chamber comprises a gas feed positioned below said grate system.

105. A mass fuel combustion furnace comprising:

a. a mass fuel feed element;

b. a combustion chamber positioned to receive mass fuel from said mass fuel feed element;

c. a grate system within said combustion chamber and having an input end and an output end across which mass fuel is transported;

d. a combustion gas feed within said combustion chamber;

e. a mix gas feed within said combustion chamber;

f. an independent mix gas pulse system which is independent of said combustion gas feed and to which said mix gas feed is responsive; and g. an ash discharge system situated in the vicinity of said output end of said grate system.

106. A mass fuel combustion furnace as described in claim 105 and further comprising a temperature control gas feed within said combustion chamber.

107. A mass fuel combustion furnace as described in claim 106 wherein said temperature control gas feed within said combustion chamber comprises a substantially uncombustible gas feed.

108. A mass fuel combustion furnace as described in claim 107 wherein said substantially uncombustible gas feed comprises a recycled combusted gas feed within said combustion chamber.

109. A mass fuel combustion furnace as described in claim 106 wherein said temperature control gas feed within said combustion chamber comprises a temperature control gas feed which is independent of both said combustion gas feed and said mix gas feed.

110. A mass fuel combustion furnace as described in claim 106 wherein said temperature control gas feed within said combustion chamber comprises a cooling gas feed.

111. A mass fuel combustion furnace as described in claim 110 wherein said cooling gas feed comprises a recycled gas feed.

112. A mass fuel combustion furnace as described in claim 106 wherein said temperature control gas feed within said combustion chamber comprises a post-combustion gas feed within said combustion chamber.

113. A mass fuel combustion furnace as described in claim 106 or 112 wherein said temperature control gas feed within said combustion chamber comprises a top gas feed positioned above said grate system.

114. A mass fuel combustion furnace as described in claim 106 or 112 wherein said temperature control gas feed within said combustion chamber comprises a gas feed positioned below said grate system.

115. A mass fuel combustion furnace as described in claim 106 wherein said mass fuel feed element comprises a low air introduction mass fuel feed system.

116. A mass fuel combustion furnace as described in claim 106 wherein said temperature control gas feed within said combustion chamber comprises an agglomerated combustion by-product reduction system.

117. A mass fuel combustion furnace as described in claim 116 wherein said agglomerated combustion by-product reduction system comprises an agglomerated combustion by-product reduction gas feed.

118. A mass fuel combustion furnace as described in claim 117 wherein said agglomerated combustion by-product reduction gas feed comprises a recycled gas feed.

119. A mass fuel combustion furnace as described in claim 105 and further comprising a gas pulse system to which said combustion gas feed is responsive.

120. A mass fuel combustion furnace as described in claim 106 and further comprising a gas pulse system to which said temperature control gas feed is responsive.

121. A mass fuel combustion furnace as described in claim 119 or 120 wherein said gas pulse system comprises a variable gas pulse system.

122. A mass fuel combustion furnace comprising:

a. a mass fuel feed element;

b. a combustion chamber positioned to receive mass fuel from said mass fuel feed element;

c. a grate system within said combustion chamber and having an input end and an output end across which said mass fuel is transported;

d. a combustion gas feed within said combustion chamber;

e. a temperature control gas feed within said combustion chamber independent of said combustion gas feed;

f. an ash discharge system situated in the vicinity of said output end of said grate system;

g. a mix gas feed within said combustion chamber; and h. an independent combustion gas pulse system which is independent of said mix gas feed and to which said combustion gas feed is responsive.

123. A mass fuel combustion furnace comprising:

a. a mass fuel feed element;

b. a combustion chamber positioned to receive mass fuel from said mass fuel feed element;

c. a grate system within said combustion chamber and having an input end and an output end across which said mass fuel is transported;

d. a combustion gas feed within said combustion chamber;

e. a temperature control gas feed within said combustion chamber independent of said combustion gas feed;

f. an ash discharge system situated in the vicinity of said output end of said grate system; and g. a gas pulse system to which at least one of said gas feeds is responsive.

124. A mass fuel combustion furnace as described in claim 123 wherein said gas pulse system to which at least one of said gas feeds is responsive comprises a variable gas pulse system.

125. A mass fuel combustion furnace comprising:

a. mass fuel feed element;

b. a combustion chamber positioned to receive mass fuel from said mass fuel feed element;

c. a grate system within said combustion chamber and having an input end and an output end across which mass fuel is transported;

d. a first gas feed within said combustion chamber;

e. a second gas feed within said combustion chamber;

f. a first gas pulse system to which only said first gas feed is responsive;

g. a second gas pulse system to which only said second gas feed is responsive; and h. an ash discharge system situated in the vicinity of said output end of said grate system.

126. A mass fuel combustion furnace as described in claim 105 or 125 wherein said gas pulse system comprises a poppet element to which gas feed is responsive.

127. A mass fuel combustion furnace as described in claim 105 or 125 wherein said gas pulse system comprises a plurality of independently controllable poppet elements to which gas feed is responsive.

128. A mass fuel combustion furnace as described in claim 127 wherein at least one of said poppet elements to which said gas feed is responsive comprises:

a. a gas housing having an end opening;

b. a controllable cap positioned adjacent said end opening of said gas housing; and c. a seal positioned between said end opening of said gas housing and said controllable cap.

129. A mass fuel combustion furnace as described in claim 125 wherein one of said gas feeds comprise a temperature control gas feed within said combustion chamber.

130. A mass fuel combustion furnace as described in claim 129 wherein said temperature control gas feed within said combustion chamber comprises a substantially uncombustible gas feed.

131. A mass fuel combustion furnace as described in claim 130 wherein said substantially uncombustible gas feed comprises a recycled combusted gas feed within said combustion chamber.

132. A mass fuel combustion furnace as described in claim 129 wherein said temperature control gas feed within said combustion chamber comprises a temperature control gas feed which is independent of both said combustion gas feed and said mix gas feed.

133. A mass fuel combustion furnace as described in claim 129 wherein said temperature control gas feed within said combustion chamber comprises a cooling gas feed.

134. A mass fuel combustion furnace as described in claim 133 wherein said cooling gas feed comprises a recycled gas feed.

135. A mass fuel combustion furnace as described in claim 129 wherein said temperature control gas feed within said combustion chamber comprises a post-combustion gas feed within said combustion chamber.

136. A mass fuel combustion furnace as described in claim 129 or 135 wherein said temperature control gas feed within said combustion chamber comprises a top gas feed positioned above said grate system.

137. A mass fuel combustion furnace as described in claim 129 or 135 wherein said temperature control gas feed within said combustion chamber comprises a gas feed positioned below said grate system.

138. A mass fuel combustion furnace as described in claim 125 wherein said mass fuel feed element comprises a low air introduction mass fuel feed system.

139. A mass fuel combustion furnace as described in claim 129 wherein said temperature control gas feed within said combustion chamber comprises an agglomerated combustion by-product reduction system.

140. A mass fuel combustion furnace as described in claim 139 wherein said agglomerated combustion by-product reduction system comprises an agglomerated combustion by-product reduction gas feed.

141. A mass fuel combustion furnace as described in claim 140 wherein said agglomerated combustion by-product reduction gas feed comprises a recycled gas feed.

142. A mass fuel combustion furnace as described in claim 125 wherein said gas pulse systems comprise a variable gas pulse system.

143. A mass fuel combustion furnace as described in claim 125 wherein said gas pulse systems each comprise a variable gas pulse system.

144. A mass fuel combustion furnace comprising:

a. a mass fuel feed element;

b. a combustion chamber positioned to receive mass fuel from said mass fuel feed element;

c. an inclined grate system within said combustion chamber;

d. a vibration element to which said inclined grate system is responsive;

e. a combustion gas feed within said combustion chamber;

f. an ash discharge system situated in the vicinity of said output end of said inclined grate system;

wherein said inclined grate system comprises a plurality of overlapping grate elements, and wherein said plurality of overlapping grate elements comprises a plurality of grate zones which are each individually responsive to said vibration element.

145. A mass fuel combustion furnace as described in claim 144 and further comprising a plurality of vibration interconnect elements each to which at least a portion of said plurality of said overlapping grate elements are responsive.

146. A mass fuel combustion furnace as described in claim 145 wherein said plurality of vibration interconnect elements are responsive to said vibration element.

147. A mass fuel combustion furnace as described in claim 145 and further comprising a plurality of vibration elements each to which at least a portion of said plurality of said interconnect elements are responsive.

148. A mass fuel combustion furnace as described in claim 146 or 147 wherein said plurality of vibration interconnect elements each comprises a rod.

149. A mass fuel combustion furnace as described in claim 148 wherein said overlapping grate elements further comprise rib elements each of which is responsive to one of said interconnect elements.

150. A mass fuel combustion furnace comprising:

a. a mass fuel feed element;

b. a combustion chamber positioned to receive mass fuel from said mass fuel feed element;

c. an inclined grate system within said combustion chamber;

d. a vibration element to which said inclined grate system is responsive;

e. a combustion gas feed within said combustion chamber, f. an ash discharge system situated in the vicinity of said output end of said inclined grate system;

wherein said inclined grate system comprises a plurality of vibrational grate zones which are each individually responsive to said vibration element.

151. A mass fuel combustion furnace as described in claim 150 and further comprising a plurality of vibration elements each to which one of said vibrational grate zones is responsive.

152. A mass fuel combustion furnace comprising:

a. a mass fuel feed element;

b. a combustion chamber positioned to receive mass fuel from said mass fuel feed element;

c. a grate system within said combustion chamber and having an input end and an output end across which said mass fuel is transported;

d. a combustion gas feed within said combustion chamber;

e. a temperature control recycled gas feed within said combustion chamber;

f. an ash discharge system situated in the vicinity of said output end of said grate system, wherein said temperature control recycled gas feed within said combustion chamber comprises a cooling gas feed.

153. A mass fuel combustion furnace as described in claim 152 wherein said temperature control recycled gas feed within said combustion chamber comprises a substantially uncombustible recycled gas feed.

154. A mass fuel combustion furnace as described in claim 153 wherein said substantially uncombustible recycled gas feed comprises a recycled combusted gas feed within said combustion chamber.

155. A mass fuel combustion furnace as described in claim 152 and further comprising a fuel mix gas feed within said combustion chamber and wherein said temperature control recycled gas feed within said combustion chamber comprises a temperature control recycled gas feed which is independent of both said combustion gas feed and said fuel mix gas feed.

156. A mass fuel combustion furnace as described in claim 152 wherein said temperature control recycled gas feed within said combustion chamber comprises a post-combustion recycled gas feed within said combustion chamber.

157. A mass fuel combustion furnace as described in claim 152 or 156 wherein said temperature controll recycled gas feed within said combustion chamber comprises a top gas feed positioned above said grate system.

158. A mass fuel combustion furnace as described in claim 152 or 156 wherein said temperature control recycled gas feed within said combustion chamber comprises a gas feed positioned below said grate system.

159. A mass fuel combustion furnace as described in claim 152 wherein said mass fuel feed element comprises a low air introduction mass fuel feed system.

160. A mass fuel combustion furnace as described in claim 152 wherein said temperature control recycled gas feed within said combustion chamber comprises an agglomerated combustion by-product reduction system.

161. A mass fuel combustion furnace as described in claim 160 wherein said agglomerated combustion by-product reduction system comprises an agglomerated combustion by-product reduction recycled gas feed.

162. A mass fuel combustion furnace as described in claim 152 and further comprising an independent combustion gas pulse system which is independent of said mix gas feed and to which said combustion gas feed is responsive.

163. A mass fuel combustion furnace as described in claim 152 and further comprising a gas pulse system to which at least one of said gas feeds is responsive.

164. A mass fuel combustion furnace as described in claim 163 wherein said gas pulse system to which at least one of said gas feeds is responsive comprises a variable gas pulse system.

* * * * *